US006451517B1

(12) United States Patent
Fukuzawa et al.

(10) Patent No.: US 6,451,517 B1
(45) Date of Patent: Sep. 17, 2002

(54) SILVER HALIDE COLOR PHOTOGRAPHIC LIGHTSENSITIVE MATERIAL AND METHOD FOR FORMING COLOR IMAGE USING THE SAME

(75) Inventors: Hiroshi Fukuzawa; Hisashi Mikoshiba; Yoshio Shimura, all of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 96 days.

(21) Appl. No.: 09/714,210

(22) Filed: Nov. 17, 2000

(30) Foreign Application Priority Data

Nov. 18, 1999 (JP) ..... 11-328261

(51) Int. Cl.[7] ..... G03C 7/46

(52) U.S. Cl. ..... 430/379; 430/549; 430/558; 430/505

(58) Field of Search ..... 430/505, 549, 430/558, 379

(56) References Cited

U.S. PATENT DOCUMENTS 4,994,351 A 2/1991 Haga et al.
5,272,049 A 12/1993 Sakanoue et al.
5,415,989 A * 5/1995 Wolff et al. ..... 430/558

FOREIGN PATENT DOCUMENTS

JP 4346342 12/1992

* cited by examiner

*Primary Examiner*—Geraldine Letscher
(74) *Attorney, Agent, or Firm*—Birch, Stewart, Kolasch & Birch, LLP

(57) ABSTRACT

A silver halide color photographic lightsensitive material includes at least one emulsion layer on a support. At least one of the emulsion layers contains a coupler represented by formula (1) below and a coupler represented by formula (2) below at a molar ratio of 1:9 to 9:1.

(1)

(2)

In formulas (1) and (2), each of $R^1$, $R^2$, $R^3$, and $R^4$ independently represents a hydrogen atom or a substituent. Each of $X^1$ and $X^2$ represents a hydrogen atom or a group capable splitting off by coupling with the oxidized form of a developing agent. At least one of $X^1$ and $X^2$ is a hydrogen atom.

11 Claims, No Drawings

SILVER HALIDE COLOR PHOTOGRAPHIC LIGHTSENSITIVE MATERIAL AND METHOD FOR FORMING COLOR IMAGE USING THE SAME

CROSS-REFERENCE TO RELATED APPLICATIONS

This application is based upon and claims the benefit of priority from the prior Japanese Patent Application No. 11-328261, filed Nov. 18, 1999, the entire contents of which are incorporated herein by reference.

BACKGROUND OF THE INVENTION

The present invention relates to a color photographic lightsensitive material and, more particularly, to a color photographic lightsensitive material having improved processing dependence on color development and high granularity and superior image storage characteristics. The present invention also relates to a method for forming color image using this color photographic lightsensitive material.

Recently, in color photographic lightsensitive materials pyrazoloazole-based couplers having little secondary absorption near 430 nm are beginning to be used instead of 5-pyrazolone-based magenta couplers conventionally used to improve color reproduction. When this pyrazoloazole-based coupler is used, however, gradation changes or color generating property changes increase owing to pH variations in a color developer. To improve this, U.S. Pat. No. 5,342,746 has disclosed the use of oleyl alcohol, and Jpn. Pat. Appln. KOKAI Publication No. (hereinafter referred to as JP-A-)3-160442 has disclosed the combination of a compound which scavenges the oxidized form of a color developing agent and a film harder. Also, JP-A-1-315735, JP-A-2-8841, and JP-A-3-125143 have disclosed methods of decreasing the dependence on pH variations by variously changing groups for substituting pyrazoloazole. However, to make the present invention the present inventors have newly found that color generating property changes caused by pH variations cannot be well improved even by the use of the above methods, and that the problem of color generating property changes caused by pH variations cannot be radically settled when processing is performed using a color developer whose pH is 11.0 or more.

Meanwhile, in silver halide photographic lightsensitive materials the image quality properties such as the granularity and the image storage characteristics are also important properties. In most pyrazoloazole-based magenta couplers described in the patents cited above, split-off groups which couple with the oxidized form of a color developing agent are substituents except for a hydrogen atom. When this substituent is a hydrogen atom, the granularity improves but yellow stains are produced in uncolored portions by humidity and heat. The granularity is more or less improved by decreasing the coupling rate of a coupler and the oxidized form of a color developing agent. However, the influence of concentration variations in a color developing agent on color generating properties increases.

As a technique close to the present invention, JP-A-4-346342 has disclosed a technique which mixes pyrazolotriazole magenta couplers having different structures. Unfortunately, in all couplers presented as practical examples in the patents cited above, split-off groups for coupling with the oxidized form of a color developing agent are groups except for a hydrogen atom. Also, the objects of these patents are different from the objects of the present invention. So, the object of the present invention cannot be achieved by the techniques of these patents.

BRIEF SUMMARY OF THE INVENTION

It is an object of the present invention to provide a color photographic lightsensitive material having improved processing dependence on color development. In particular, it is an object of the present invention to provide a color photographic lightsensitive material having improved color generating property changes with pH variations when color development is performed using a color developer whose pH is 11.0 or more, having improved color generating property changes with concentration variations in a color developing agent, and having high granularity and superior image storage characteristics. It is another object of the present invention to provide a method for forming color image using this color photographic lightsensitive material.

The present inventors made extensive studies to achieve high granularity and good image storage characteristics and further to improve color generating property changes with pH variations on color development and color generating property changes with concentration variations in a developing agent. Consequently, the present invention is accomplished by the following means.

(1) A silver halide color photographic lightsensitive material comprising at least one emulsion layer on a support, wherein at least one of the emulsion layers contains a coupler represented by formula (1) below and a coupler represented by formula (2) below at a molar ratio of 1:9 to 9:1, and at least one of substituents $X^1$ and $X^2$ is a hydrogen atom.

(1)

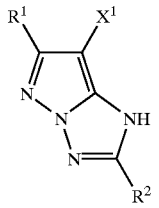

(2)

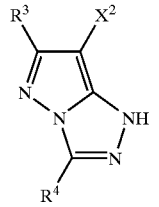

In formulas (1) and (2), each of $R^1$, $R^2$, $R^3$, and $R^4$ independently represents a hydrogen atom or a substituent. Each of $X^1$ and $X^2$ represents a hydrogen atom or a group capable of splitting off by coupling with the oxidized form of a developing agent. At least one of $X^1$ and $X^2$ is a hydrogen atom.

(2) A silver halide color photographic lightsensitive material comprising at least one emulsion layer on a support, wherein at least one of the emulsion layers contains a coupler represented by formula (1) below and a coupler represented by formula (3) below at a molar ratio of 1:9 to 9:1:

(1)

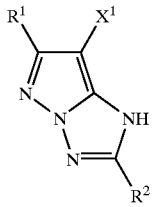

(3)

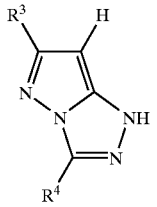

In formula (1), each of $R^1$ and $R^2$ independently represents a hydrogen atom or a substituent. $X^1$ represents a hydrogen atom or a group capable of splitting off by coupling with the oxidized form of a developing agent.

In formula (3), $R^3$ represents a substituted or nonsubstituted, 5- to 20-carbon secondary alkyl group or substituted or nonsubstituted, 4- to 20-carbon tertiary alkyl group. $R^4$ represents a hydrogen atom or a substituent.

(3) The silver halide color photographic lightsensitive material described in item (2) above, wherein a coupler represented by formula (3) has in $R^3$ or $R^4$ a dissociative substituent having a pka of 10 or less, which is measured at 25° C. in tetrahydrofuran:water=6:4.

(4) A method for forming color image, wherein the lightsensitive material described in item (1) above is subjected to imagewise exposure, negative black-and-white development, and color development in this order.

(5) The lightsensitive material described in item (1) above, characterized in that each substituent of the formula (1) is as follows:

$R^1$ represents a substituted or nonsubstituted alkyl group having 1 to 20 carbon atoms; $R^2$ represents a substituted or nonsubstituted aryl group having 6 to 20 carbon atoms; and $X^1$ represents a halogen atom, aryloxy group having 6 to 20 carbon atoms, or hydrogen atom.

(6) The lightsensitive material described in item (1) above, characterized in that each substituent of the formula (1) is as follows:

$R^1$ represents a substituted or nonsubstituted tertiary alkyl group having 4 to 20 carbon atoms; $R^2$ represents a substituted secondary alkyl group having 3 to 20 carbon atoms or substituted aryl group having 6 to 20 carbon atoms; and $X^1$ represents a hydrogen atom or chlorine atom.

(7) The lightsensitive material described in item (1) above, characterized in that each substituent of the formula (1) is as follows:

$R^1$ represents a nonsubstituted tertiary alkyl group having 4 to 20 carbon atoms; $R^2$ represents a substituted aryl group having 6 to 20 carbon atoms; and $X^1$ represents a chlorine atom.

(8) The lightsensitive material described in item (2) above, characterized in that each substituent of the formula (3) is as follows:

$R^3$ represents a substituted or nonsubstituted alkyl group having 1 to 20 carbon atoms; and $R^4$ represents a substituted or nonsubstituted alkyl group having 2 to 20 carbon atoms or substituted or nonsubstituted aryl group having 6 to 20 carbon atoms.

(9) The lightsensitive material described in item (2) above, characterized in that each substituent of the formula (3) is as follows:

$R^3$ represents a nonsubstituted tertiary alkyl group having 4 to 20 carbon atoms; and $R^4$ represents a substituted secondary alkyl group having 3 to 20 carbon atoms.

(10) A method for forming color image, wherein the lightsensitive material described in item (2) above is subjected to imagewise exposure, negative black-and-white development, and color development in this order.

(11) A method for forming color image, wherein the lightsensitive material described in item (3) above is subjected to imagewise exposure, negative black-and-white development, and color development in this order.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in detail below.

First, details of formula (1) will be explained.

In formula (1), each of $R^1$ and $R^2$ independently represents a hydrogen atom or a substituent. $X^1$ represents a hydrogen atom or a group capable of splitting off by coupling with the oxidized form of a developing agent.

Preferred examples of $R^1$ and $R^2$ are a hydrogen atom, halogen atom, alkyl group, alkenyl group, alkynyl group, cycloalkyl group, aryl group, heterocyclic group, cyano group, hydroxyl group, nitro group, carboxyl group, alkoxy group, aryloxy group, silyloxy group, heterocyclic oxy group, acyloxy group, carbamoyloxy group, alkoxycarbonyloxy group, aryloxycarbonyloxy group, amino group (including an anilino group), acylamino group, aminocarbonylamino group, alkoxycarbonylamino group, aryloxycarbonylamino group, sulfamoylamino group, alkylsulfonylamino and arylsulfonylamino groups, alkylthio group, arylthio group, heterocyclic thio group, sulfamoyl group, sulfo group, sulfinyl group, sulfenyl group, alkylsulfonyl and arylsulfonyl groups, acyl group, aryloxycarbonyl group, alkoxycarbonyl group, carbamoyl group, azo group, imide group, and phosphoryl group.

More specifically, examples of $R^1$ and $R^2$ are a hydrogen atom, halogen atom (e.g., a chlorine atom, bromine atom, and iodine atom), alkyl group (a straight-chain or branched-chain, substituted or nonsubstituted alkyl group, preferably a 1- to 30-carbon alkyl group, e.g., methyl, ethyl, n-propyl, isopropyl, t-butyl, n-octyl, eicosyl, 2-chloroethyl, 2-cyanoethyl, and 2-ethylhexyl), alkenyl group (a substituted or nonsubstituted alkenyl group, preferably a 2- to 30-carbon, substituted or nonsubstituted alkenyl group, e.g., allyl, prenyl, geranyl, and oleyl), alkynyl group (a substituted or nonsubstituted alkynyl group, preferably a 2- to 30-carbon, substituted or nonsubstituted alkynyl group, e.g., ethynyl and propargyl), cycloalkyl group (a substituted or nonsubstituted cycloalkyl group, preferably a 5- to 7-carbon, substituted or nonsubstituted cycloalkyl group, e.g., cyclohexyl and cyclopentyl), aryl group (preferably a 6- to 30-carbon, substituted or nonsubstituted aryl group, e.g., phenyl, p-tolyl, naphthyl, m-chlorophenyl, and o-hexadecanoylaminophenyl), heterocyclic group (preferably a 5- or 6-membered, substituted or nonsubstituted aromatic or non-aromatic heterocyclic ring, and more preferably, a 3- to 20-carbon, 5- or 6-membered aromatic heterocyclic ring, e.g., 2-furyl, 2-thienyl, 2-pyrimidinyl, and 2-benzothiazolyl), cyano group, hydroxyl group, nitro group, carboxyl group, alkoxy group (preferably a 1- to 30-carbon, substituted or nonsubstituted alkoxy group, e.g., methoxy, ethoxy, isopropoxy, t-butoxy, n-octyloxy, and 2-methoxyethoxy), aryloxy group (preferably a 6- to 30-carbon, substituted or nonsubstituted aryloxy group, e.g., phenoxy, 2-methylphenoxy, 4-t-butylphenoxy, 3-nitrophenoxy, and 2-tetradecanoylaminophenoxy), silyloxy group (preferably a 3- to 20-carbon silyloxy group, e.g., trimethylsilyloxy and t-butyldimethylsilyloxy), heterocyclic oxy group (preferably a 2- to 20-carbon, substituted or nonsubstituted heterocyclic oxy group, e.g., 1-phenyltetrazole-5-oxy and 2-tetrahydropyranyloxy), acyloxy group (preferably 2- to 30-carbon, substituted or nonsubstituted acyloxy, e.g., formyloxy, acetyloxy, pivaloyloxy, and stearoyloxy), carbamoyloxy group (preferably 1- to 30-carbon, substituted or nonsubstituted carbamoyloxy, e.g., dimethylcarbamoyloxy, diethylcarbamoyloxy, morpholinocarbonyloxy, and di-n-octylcarbamoyloxy), alkoxycarbonyloxy group (preferably a 2- to 30-carbon, substituted or nonsubstituted alkoxycarbonyloxy group, e.g., methoxycarbonyloxy, ethoxycarbonyloxy, t-butoxycarbonyloxy, and n-octylcarbonyloxy), aryloxycarbonyloxy group (preferably 7- to 30-carbon, substituted or nonsubstituted aryloxycarbonyloxy, e.g., phenoxycarbonyloxy, p-methoxyphenoxycarbonyloxy, and p-n-hexadecyloxyphenoxycarbonyloxy), amino group (including an anilino group) (preferably a 1- to 30-carbon, substituted or nonsubstituted alkylamino group and 6- to 30-carbon, substituted or nonsubstituted anilino group, e.g., amino, methylamino, dimethylamino, anilino, N-methylanilino, and diphenylamino), acylamino group (preferably 2- to 30-carbon, substituted or nonsubstituted acylamino, e.g., formylamino, acetylamino, pivaloylamino, and lauroylamino), aminocarbonylamino group (preferably 1- to 30-carbon, substituted or nonsubstituted aminocarbonylamino, e.g., carbamoylamino, dimethylaminocarbonylamino, diethylaminocarbonylamino, and morpholinocarbonylamino), alkoxycarbonylamino group (preferably 2- to 30-carbon, substituted or nonsubstituted alkoxycarbonylamino, e.g., methoxycarbonylamino, ethoxycarbonylamino, t-butoxycarbonylamino, n-octadecyloxycarbonylamino, and N-methylmethoxycarbonylamino), aryloxycarbonylamino group (preferably 7- to 30-carbon, substituted or nonsubstituted aryloxycarbonylamino, e.g., phenoxycarbonylamino, p-chlorophenylcarbonylamino, and m-n-octyloxycarbonylamino), sulfamoylamino group (preferably 0- to 30-carbon, substituted or nonsubstituted sulfamoylamino, e.g., sulfamoylamino, dimethylsulfamoylamino, and n-octylsulfamoylamino), alkylsulfonylamino and arylsulfonylamino groups {(preferably 1- to 30-carbon, substituted or nonsubstituted alkylsulfonylamino, e.g., methanesulfonylamino and butanesulfonylamino), and (preferably 6- to 30-carbon, substituted or nonsubstituted arylsulfonylamino, e.g., phenylsulfonylamino (benzenesulfonylamino) and toluenesulfonylamino (p-methylphenylsulfonylamino))}, alkylthio group (preferably a 1- to 30-carbon, substituted or nonsubstituted alkylthio group, e.g., methylthio, ethylthio, and n-hexadecylthio), arylthio group (preferably 6- to 30-carbon, substituted or nonsubstituted arylthio, e.g., phenylthio, tolylthio, and m-methoxyphenylthio), heterocyclic thio group (preferably 3- to 30-carbon, substituted or nonsubstituted heterocyclic thio, e.g., 2-benzothiazolylthio and 2,4-di-phenoxy-1,3,5-triazole-6-thio), sulfamoyl group (preferably 0- to 30-carbon, substituted or nonsubstituted sulfamoyl, e.g., N-ethylsulfamoyl, N-(2-dodecyloxyethyl) sulfamoyl, and N,N-dimethylsulfamoyl), sulfo group, sulfinyl group, sulfenyl group, alkylsulfonyl and arylsulfonyl groups {(preferably a 1- to 30-carbon, substituted or nonsubstituted alkylsulfonyl group, e.g., methanesulfonyl and ethanesulfonyl), and (preferably 6- to 30-carbon, substituted or nonsubstituted arylsulfonyl, e.g., benzenesulfonyl and toluenesulfonyl)}, acyl group {(preferably 1- to 30-carbon, substituted or nonsubstituted alkylcarbonyl, e.g., acetyl, pivaloyl, 2-chloroacetyl, and stearoyl), and (preferably 7- to 30-carbon, substituted or nonsubstituted arylcarbonyl, e.g., benzoyl and p-n-octyloxyphenylcarbonyl)}, aryloxycarbonyl group (preferably a 7- to 30-carbon, substituted or nonsubstituted aryloxycarbonyl group, e.g., phenoxycarbonyl, o-chlorophenoxycarbonyl, m-nitrophenoxycarbonyl, and p-t-butylphenoxycarbonyl), alkoxycarbonyl group (preferably a 2- to 30-carbon, substituted or nonsubstituted alkoxycarbonyl group, e.g., methoxycarbonyl, ethoxycarbonyl, t-butoxycarbonyl, and n-octadecyloxycarbonyl), carbamoyl group (preferably 1- to 30-carbon, substituted or nonsubstituted carbamoyl, e.g., aminocarbonyl, N-methylaminocarbonyl, N,N-dimethylaminocarbonyl, and N,N-di-n-octylaminocarbonyl), azo group {(preferably 6- to 30-carbon, substituted or nonsubstituted arylazo, e.g., phenylazo and p-chlorophenylazo), and (preferably 6- to 30-carbon, substituted or nonsubstituted heterocyclic azo, e.g., 5-ethylthio-1,3,4-thiadiazole-2-ylazo)}, imide group (preferably N-succinimide and N-phthalimide), and phosphoryl group (preferably 0- to 30-carbon, substituted or nonsubstituted phosphoryl, e.g., phenoxyphosphoryl and octyloxyphosphoryl).

Examples of a substituent which $R^1$ and $R^2$ can be further substituted are those enumerated above for $R^1$ and $R^2$.

$R^1$ is more preferably a substituted or nonsubstituted alkyl group (having 1 to 20 carbon atoms), particularly a substituted or nonsubstituted tertiary alkyl group (having 4 to 20 carbon atoms). $R^1$ is most preferably a nonsubstituted tertiary alkyl group (having 4 to 20 carbon atoms).

$R^2$ is more preferably a substituted or nonsubstituted alkyl group (having 1 to 20 carbon atoms) or substituted or nonsubstituted aryl group (having 6 to 20 carbon atoms). When $R^2$ is an alkyl group, this alkyl group is preferably a substituted secondary alkyl group (having 3 to 20 carbon atoms). When $R^2$ is an aryl group, this aryl group is preferably a substituted aryl group (having 6 to 20 carbon atoms). Preferred examples of a substituent which the aryl group can have are an alkoxy group, chlorine atom, cyano group, and acylamino group.

$X^1$ is preferably a halogen atom, aryloxy group (having 6 to 20 carbon atoms), or hydrogen atom, and more preferably, a hydrogen atom or chlorine atom.

In a preferred structure of formula (1), $R^1$ is a nonsubstituted tertiary alkyl group (having 4 to 20 carbon atoms), $R^2$ is a substituted aryl group (having 6 to 20 carbon atoms), and $X^1$ is a chlorine atom. Preferred examples of a substituent which the aryl group can have are an alkoxy group, chlorine atom, cyano group, and acylamino group.

Practical examples of a compound represented by formula (1) will be presented below. However, the present invention is not limited to these examples.

I-1.
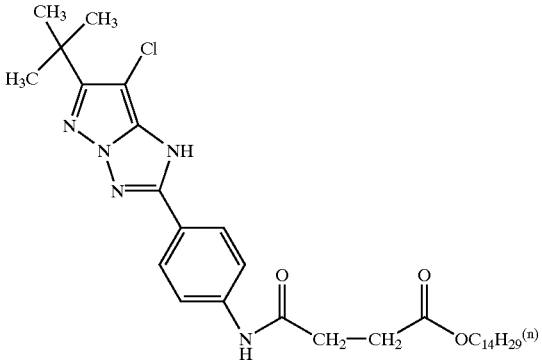
I-2.
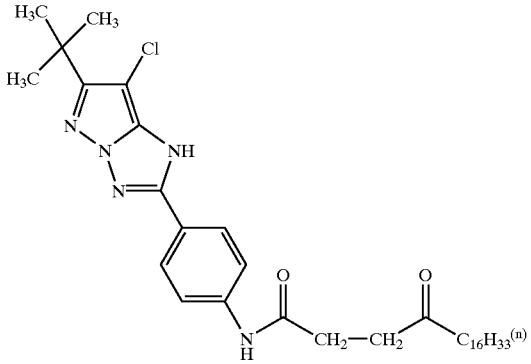
I-3.
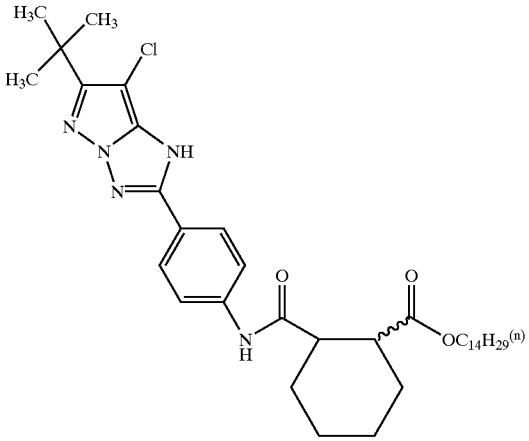
I-3.
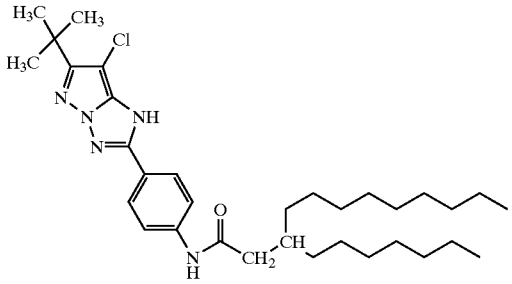
I-5.
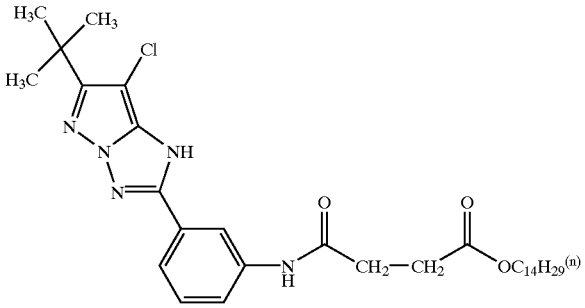
I-6.
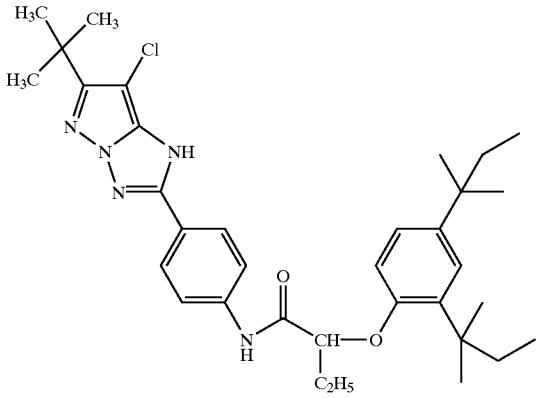

-continued
I-7.
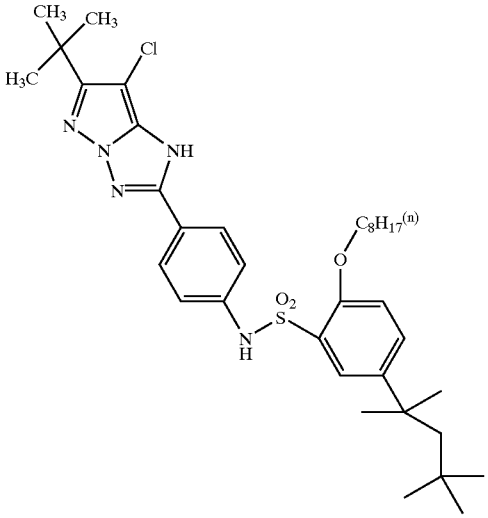
I-8.
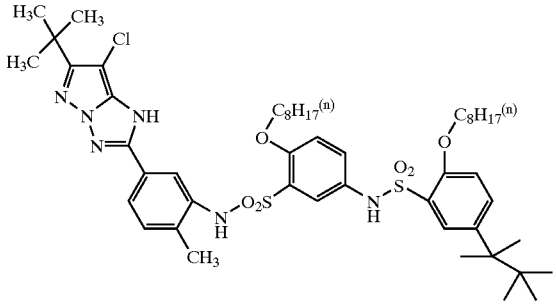
I-9.
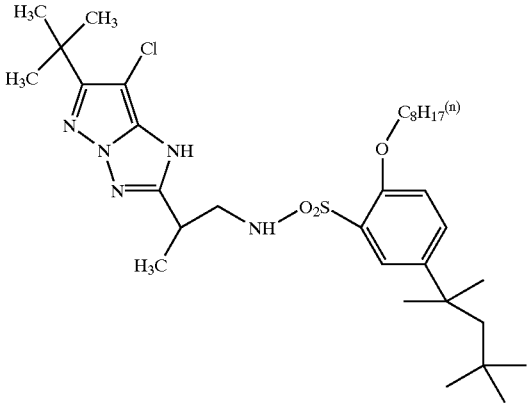
I-10.
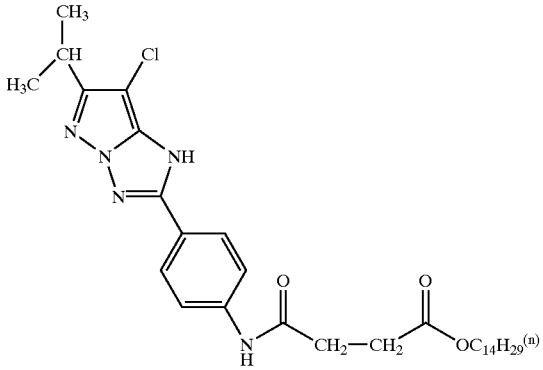
I-11.
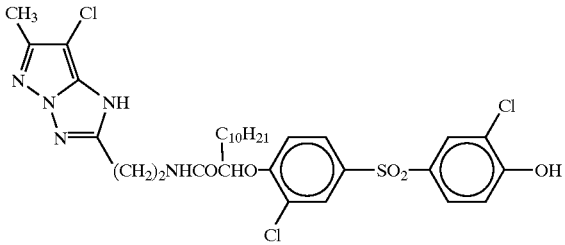
I-12.
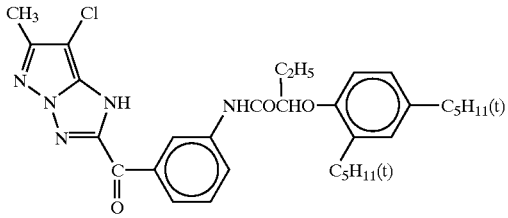
I-13.
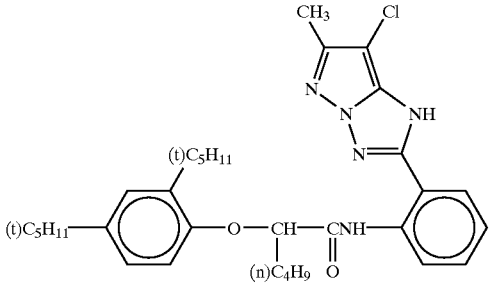
I-14.
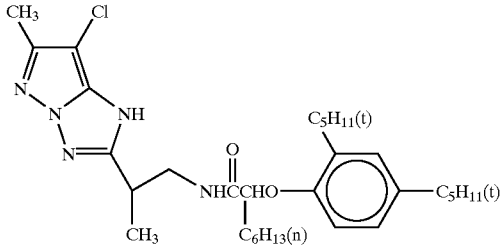

-continued
I-15.
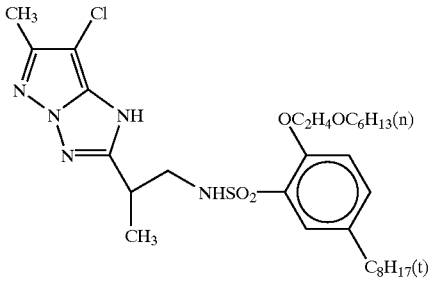
I-16.
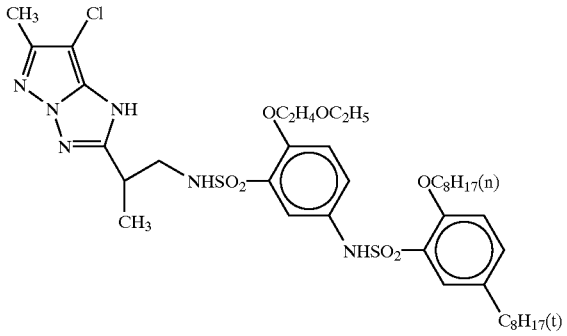
I-17.
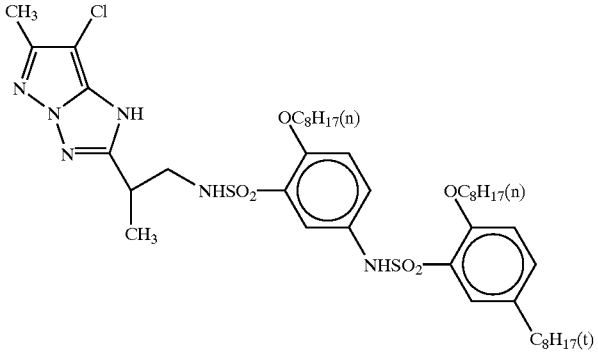
I-18.
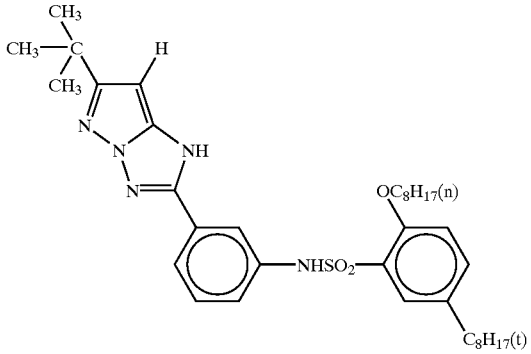
I-19.
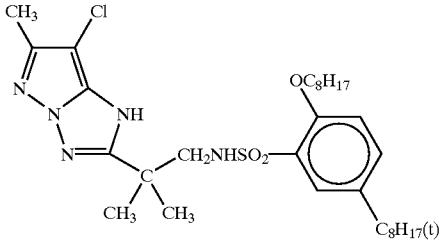
I-20.
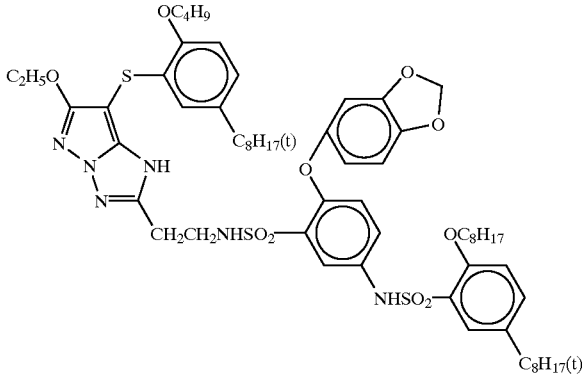
I-21.
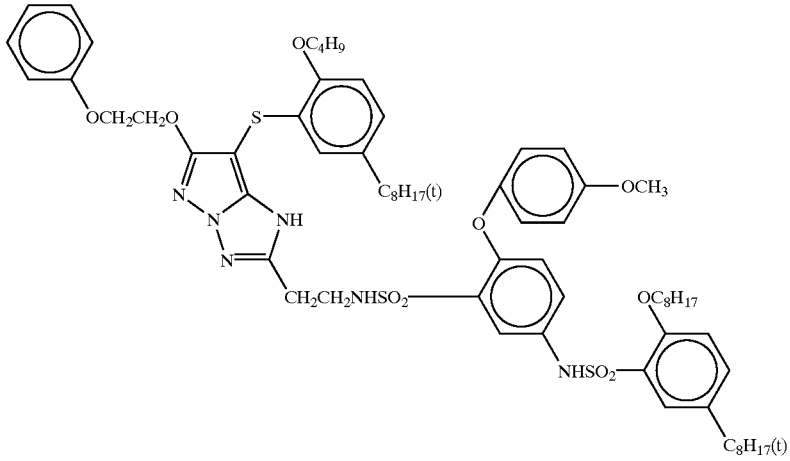

-continued
I-22.
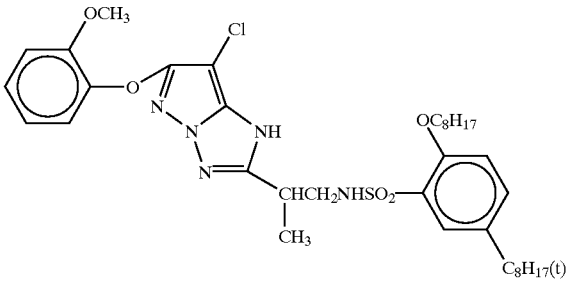
I-23.
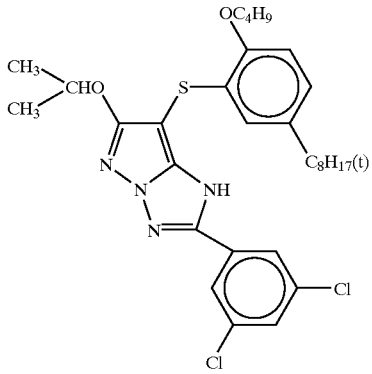
I-24.
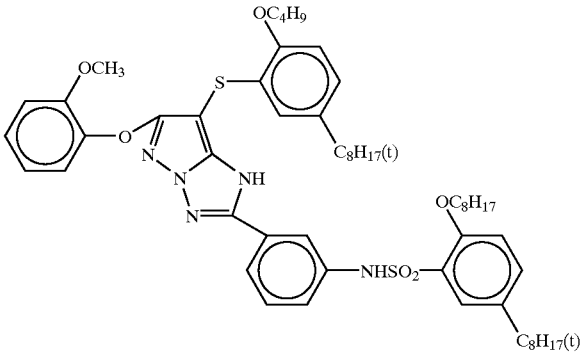
I-25.
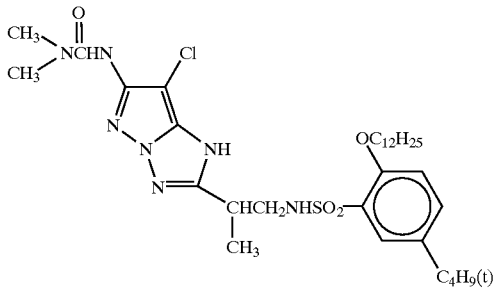
I-26.
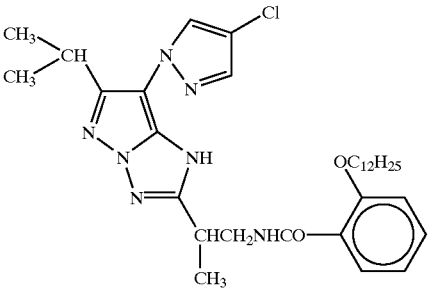
I-27.
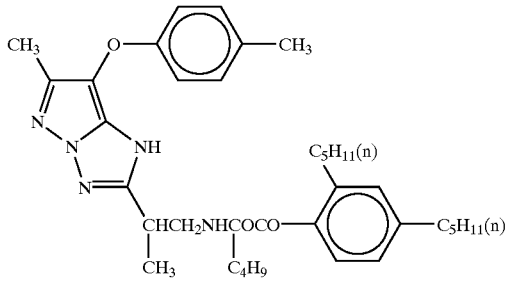
I-28.
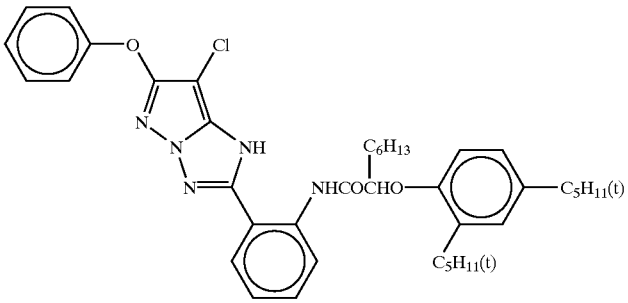
I-29.
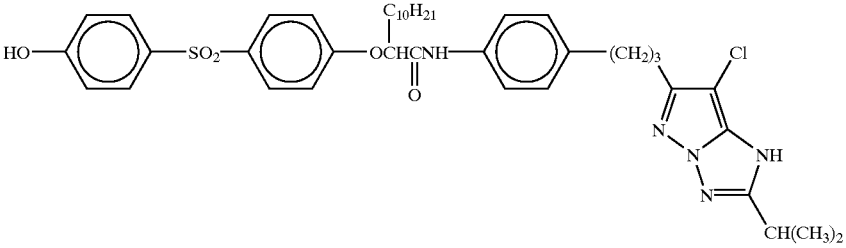

-continued
I-30.
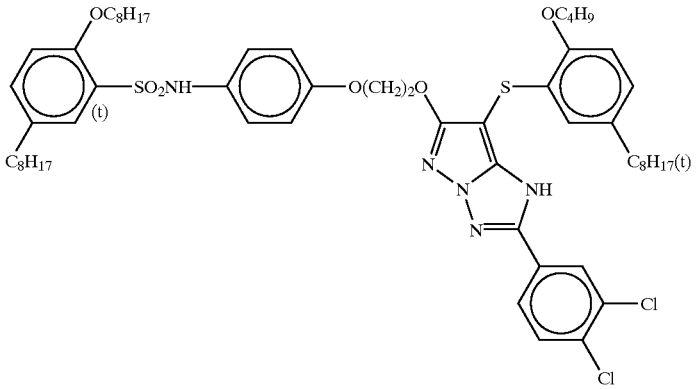
I-31.
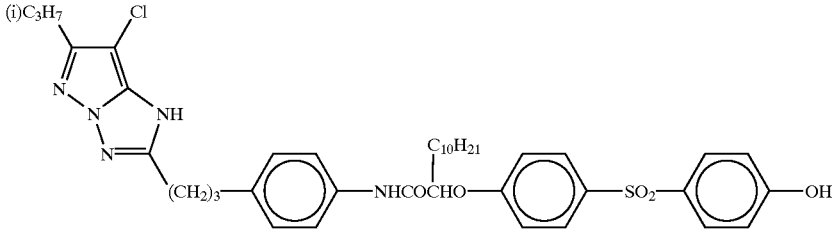
I-32.
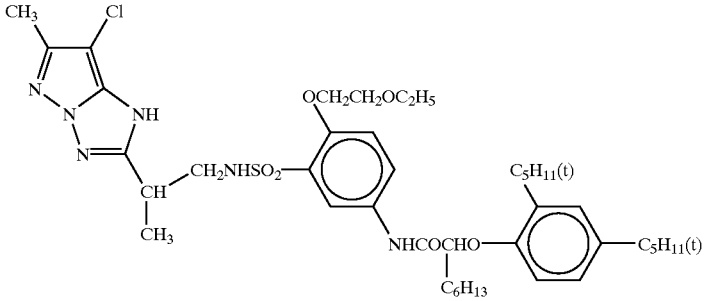
I-33.
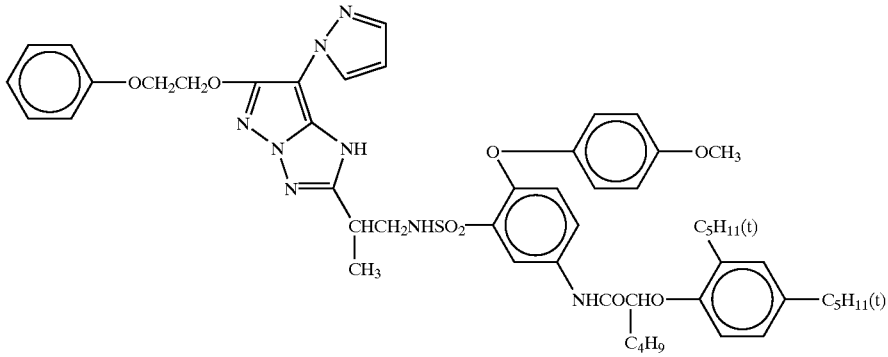

-continued
I-34.
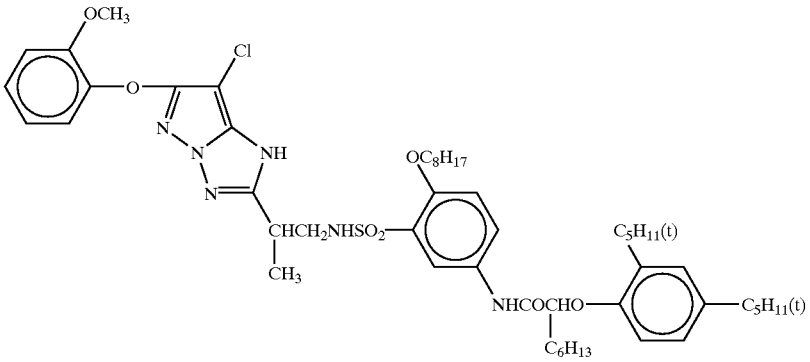
I-35.
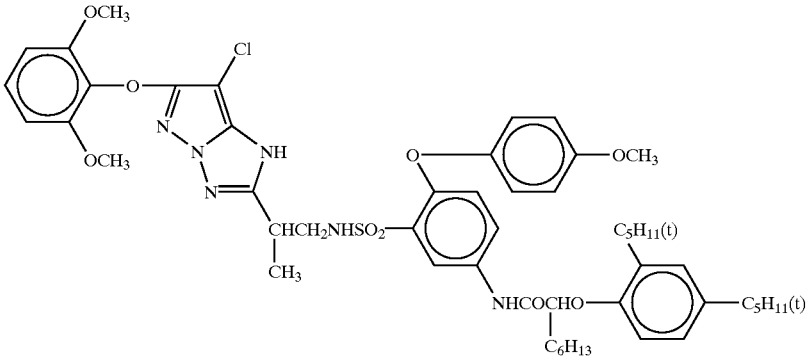
I-36.
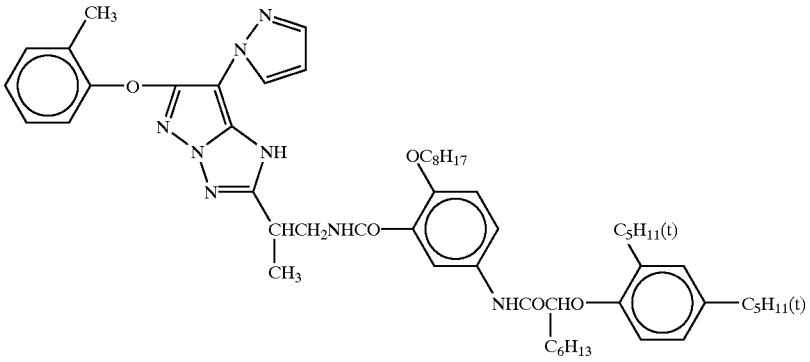
I-37.
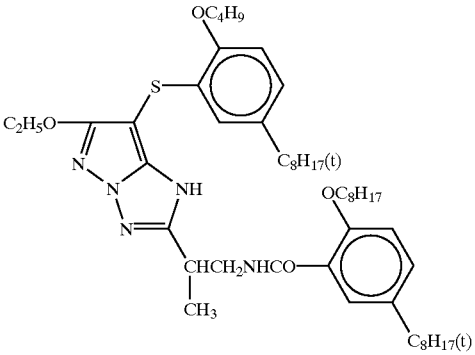
I-38.
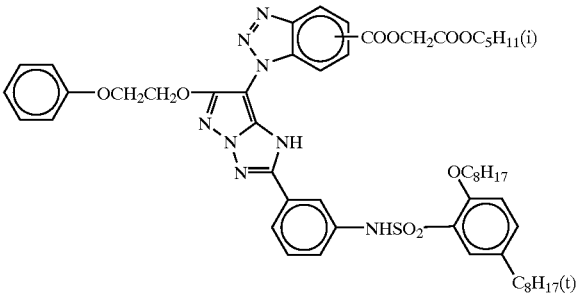

-continued

I-39.

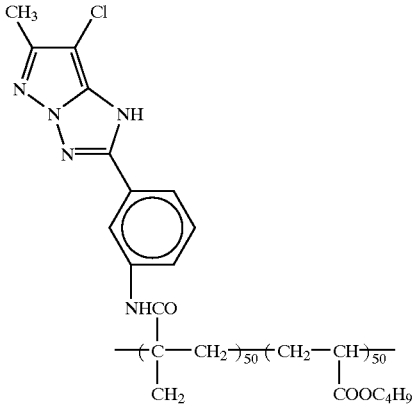

Formula (2) will be described in detail below. Each of $R^3$ and $R^4$ independently represents a hydrogen atom or a substituent. $X^2$ represents a hydrogen atom or a group capable of splitting off by coupling with the oxidized form of a developing agent. $X^2$ is preferably a halogen atom, aryloxy group (having 6 to 20 carbon atoms), or hydrogen atom.

Examples of a substituent represented by $R^3$ and $R^4$ are those enumerated above for $R^1$ and $R^2$ in formula (1).

$R^3$ is more preferably a substituted or nonsubstituted alkyl group (having 1 to 20 carbon atoms). $R^4$ is preferably a substituted or nonsubstituted alkyl group (having 2 to 20 carbon atoms) or substituted or nonsubstituted aryl group (having 6 to 20 carbon atoms). $X^2$ is preferably a hydrogen atom.

A coupler represented by formula (2) preferably has a structure represented by formula (3). In formula (3), $R^3$ represents a substituted or nonsubstituted secondary alkyl group (having 5 to 20 carbon atoms) or substituted or nonsubstituted tertiary alkyl group (having 4 to 20 carbon atoms), and $R^4$ represents a hydrogen atom or a substituent. $R^3$ is preferably a nonsubstituted tertiary alkyl group (having 4 to 20 carbon atoms, e.g., t-butyl). $R^4$ is preferably a substituted or nonsubstituted alkyl group (having 2 to 20 carbon atoms) or substituted or nonsubstituted aryl group (having 6 to 20 carbon atoms). When $R^4$ is an alkyl group, this alkyl group is preferably a substituted tertiary alkyl group (having 4 to 20 carbon atoms) or substituted secondary alkyl group (having 3 to 20 carbon atoms). Preferred examples of a substituent which the tertiary alkyl group and the secondary alkyl group can have are an alkylsulfonylamino group, arylsulfonylamino group, acylamino group, aminocarbonylamino group, alkoxycarbonylamino group, and alkoxy group. When $R^4$ is an aryl group, this aryl group is preferably a substituted aryl group (having 6 to 20 carbon atoms). Preferred examples of a substituent which the aryl group can have are an alkylsulfonylamino group, arylsulfonylamino group, acylamino group, aminocarbonylamino group, alkoxycarbonylamino group, and alkoxy group.

Preferably, a coupler has in $R^3$ or $R^4$ a dissociative substituent having a pKa of 10 or less, which is measured at 25° C. in tetrahydrofuran:water=6:4. More preferably, a coupler has in $R^4$ a dissociative substituent having a pKa of 10 or less, which is measured at 25° C. in tetrahydrofuran:water=6:4. The pKa was measured by an acid-base titration method.

Measurement conditions: tetrahydrofuran:water=60:40 temperature 25° C.

Examples of a dissociative substituent having a pKa of 10 or less under the conditions are —CO—NH—$SO_2$—, —COOH, a phenolic hydroxyl group, and —NH$SO_2$—.

In the most preferred example of a structure represented by formula (3), $R^3$ is a nonsubstituted tertiary alkyl group (having 4 to 20 carbon atoms), particularly t-butyl, and $R^4$ is a substituted secondary alkyl group (having 3 to 20 carbon atoms), particularly a 1-methylalkyl group whose 1-position is substituted. Preferred examples of a substituent which the secondary alkyl group can have are an alkylsulfonylamino group, arylsulfonylamino group, acylamino group, aminocarbonylamino group, alkoxycarbonylamino group, and alkoxy group. Also, preferred examples of a substituent which the 1-methylalkyl group can have are an alkylsulfonylamino group, arylsulfonylamino group, and acylamino group.

A coupler more preferably has in $R^4$ a dissociative substituent having a pKa of 10 or less, which is measured under the conditions described above.

The most preferred example of a structure represented by formula (3) is a structure represented by formula (4) below.

(4)

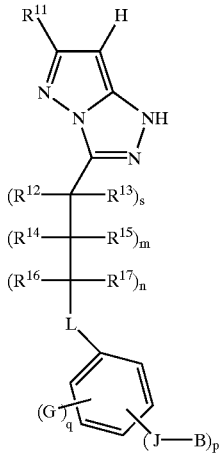

In formula (4), $R^{11}$ has the same meaning as $R^1$ in formula (1). Each of $R^{12}$, $R^{13}$, $R^{14}$, $R^{15}$, $R^{16}$, and $R^{17}$ independently represents a hydrogen atom, halogen atom, alkoxy group, alkyl group, or aryl group. L represents —$NR^{18}SO_2$—, —$SO_2NR^{18}$—, —$SO_2NR^{18}CO$—, —$NR^{18}COO$—, —$NR^{18}CONR^{19}$—, or —COO— (each of which bonds to a phenyl group in formula (4) on the right-hand side). Each of $R^{18}$ and $R^{19}$ independently represents a hydrogen atom, substituted or nonsubstituted alkyl group, or substituted or nonsubstituted aryl group. J represents —CO—, —COO—, —O—, —S—, —$CONR^{20}$—, —$NR^{20}CO$—, —$NR^{20}COO$—, —$NR^{20}NR^{21}$—, —$SO_2$—, —$SO_2NR^{20}$—, or —$CONR^{20}SO_2$— (each of which bonds to a phenyl group in formula (4) on the left-hand side). Each of $R^{20}$ and $R^{21}$ independently represents a hydrogen atom, substituted or nonsubstituted alkyl group, or substituted or nonsubstituted aryl group. B represents a substituted or nonsubstituted alkyl group or substituted or nonsubstituted aryl group. p represents an integer of 1 to 5. If p is 2 or more, a plurality of -J-B's can be different. G represents a substituent. q represents an integer of 0 to 4. If q is 2 or more, a plurality of G's can be different. Each of s, m, and n independently represents 0 or 1.

Formula (4) will be described in detail below. $R^{11}$ has the same meaning as $R^1$ in formula (1), and its practical examples and preferred examples are also the same as $R^1$.

Each of $R^{12}$, $R^{13}$, $R^{14}$, $R^{15}$, $R^{16}$, and $R^{17}$ independently represents a hydrogen atom, halogen atom, alkoxy group, alkyl group, or aryl group, each of which can be substituted by a substituent. Examples of the substituent are those enumerated above for $R^1$ in formula (1). Also, any two of $R^{12}$, $R^{13}$, $R^{14}$, $R^{15}$, $R^{16}$, and $R^{17}$ can bond to form a ring structure together with the C—C or the C—C—C to which $R^{12}$, $R^{13}$, $R^{14}$, $R^{15}$, $R^{16}$, and $R^{17}$ attach in formula (4).

Each of $R^{12}$, $R^{13}$, $R^{14}$, $R^{15}$, $R^{16}$, and $R^{17}$ is preferably a hydrogen atom, alkyl group (having 1 to 20 carbon atoms), or aryl group (having 6 to 20 carbon atoms). More preferably, at least one of $R^{12}$ and $R^{13}$ is an alkyl group or aryl group, and each of $R^{14}$, $R^{15}$, $R^{16}$, and $R^{17}$ is a hydrogen atom, alkyl group, or aryl group. More preferably, at least one of $R^{12}$ and $R^{13}$ is a group selected from a methyl group, ethyl group, and isopropyl group, and each of $R^{14}$, $R^{15}$, $R^{16}$, and $R^{17}$ is a hydrogen atom, alkyl group, or aryl group.

Each of s, m, and n independently represents 0 or 1. Preferably, s and m are 1s and n is 0, or s is 1 and m and n are 0s.

L is preferably —$NR^{18}SO_2$—, —$SO_2NR^{18}$—, or —$SO_2NR^{18}CO$—. $R^{18}$ is preferably a hydrogen atom.

B is preferably a substituted or nonsubstituted alkyl group having a total number of carbon atoms of 1 to 70 or substituted or nonsubstituted aryl group having a total number of carbon atoms of 6 to 70.

J is preferably —COO—, —O—, —$CONR^{20}$—, —$NR^{20}CO$—, —$NR^{20}COO$—, —$NR^{20}NR^{21}$—, —$SO_2NR^{20}$—, or —$CONR^{20}SO_2$—. $R^{20}$ is preferably a hydrogen atom or nonsubstituted alkyl group having 1 to 20 carbon atoms. One of $R^{20}$ and $R^{21}$ is preferably a hydrogen atom. A preferred substitution position of (J-B) is the o-position with respect to L.

G is a substituent which can substitute a phenyl group. Practical examples are those enumerated above for $R^1$ in formula (1). G is preferably an alkyl group having 1 to 20 carbon atoms, halogen atom, or alkoxy group having 1 to 20 carbon atoms. The substitution position of G is preferably the m-position with respect to L, and is the p-position with respect to (J-B) if (J-B) is the o-position with respect to L.

In a preferred structure of formula (4), $R^{11}$ is a nonsubstituted tertiary alkyl group (having 4 to 20 carbon atoms), $R^{12}$ is an alkyl group (having 1 to 4 carbon atoms), $R^{13}$ is a hydrogen atom or alkyl group (having 1 to 4 carbon atoms), s is 1, m and n are 0s, L is —$NHSO_2$—, —$SO_2NH$—, or —$SO_2NHCO$—, J is —$SO_2NH$—, —$CONHSO_2$—, or —O—, B is a substituted or nonsubstituted alkyl group (having 1 to 30 carbon atoms) or substituted or nonsubstituted aryl group (having 6 to 30 carbon atoms), p is 1, G is nonsubstituted tertiary alkyl group (having 1 to 20 carbon atoms), and q is 1.

Practical examples of a compound represented by formula (2) will be presented below. However, the present invention is not limited to these examples.

II-1.

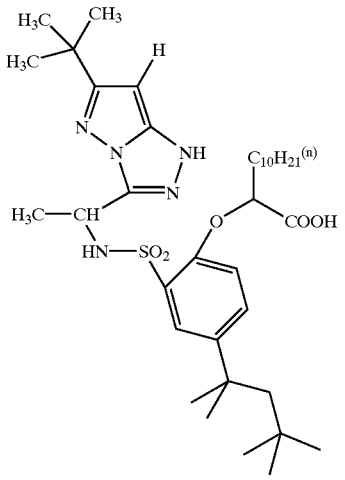

II-2.

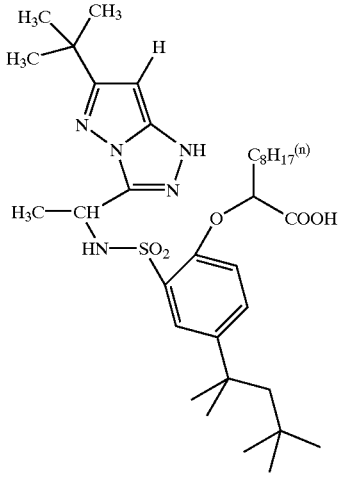

II-3.

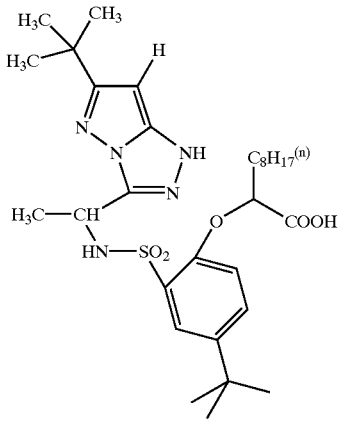

-continued
II-4.
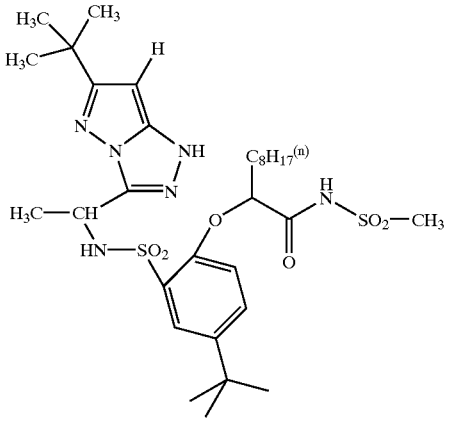
II-5.
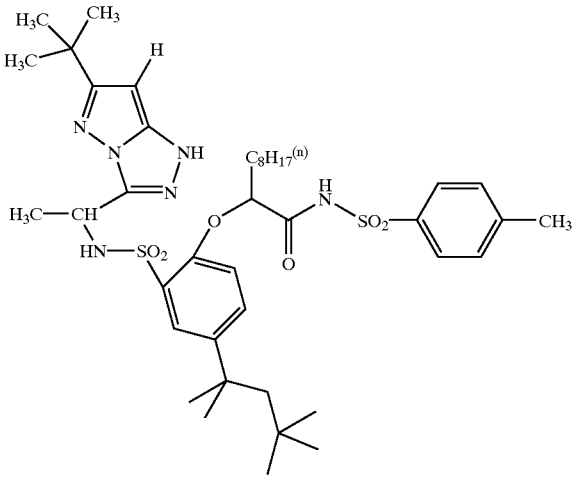
II-6.
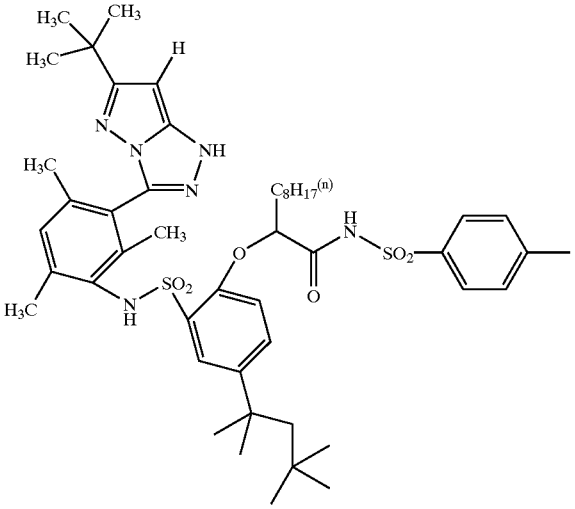
-continued
II-7.
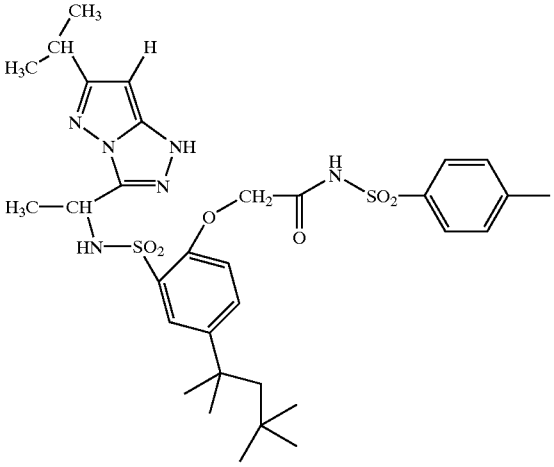
II-8.
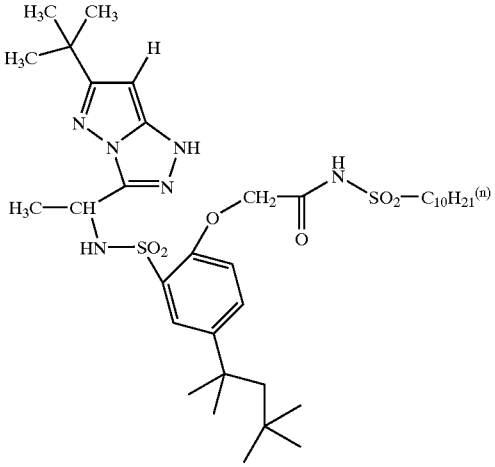
II-9.
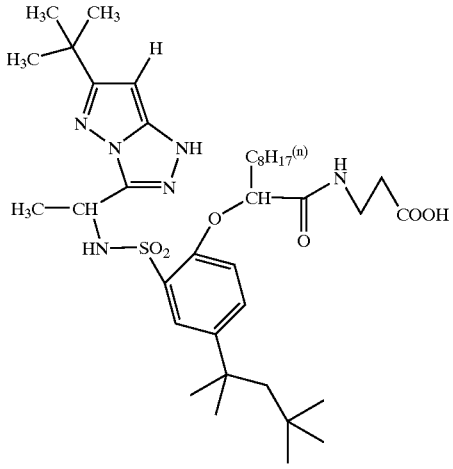

-continued
II-10.
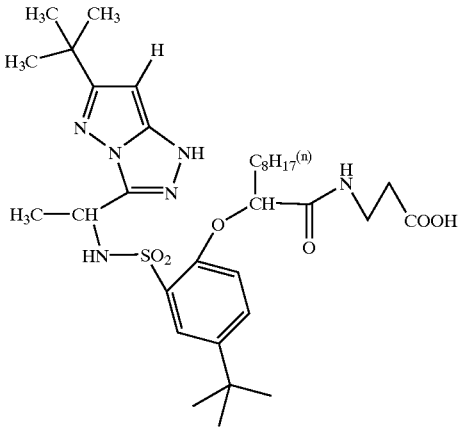
II-11.
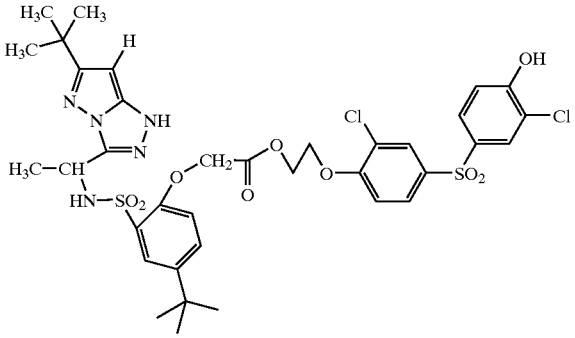
II-12.
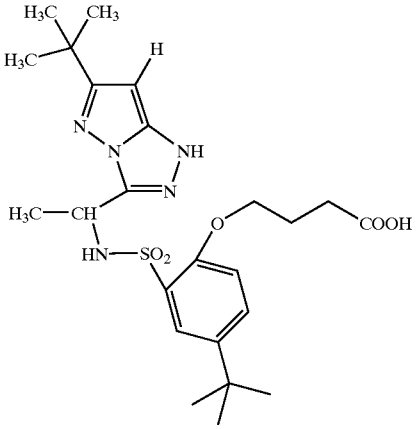
-continued
II-13.
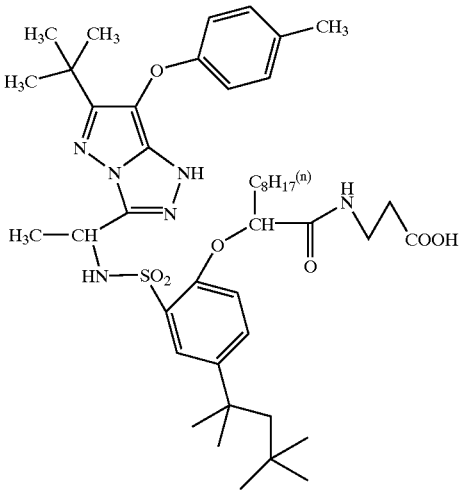
II-14.
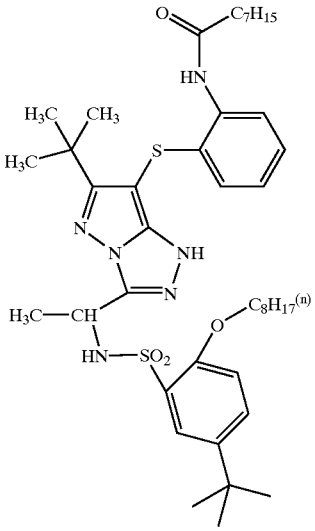
II-15.
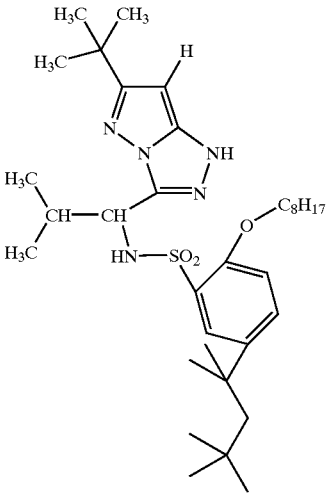

-continued
II-16.
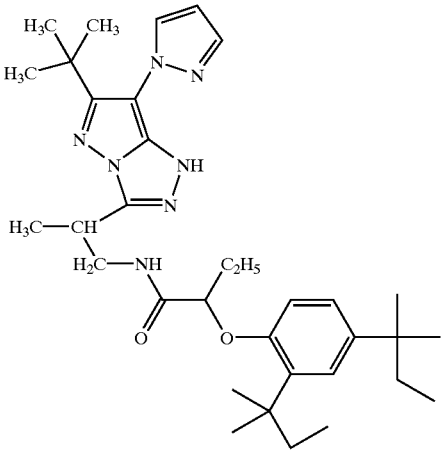
II-17.
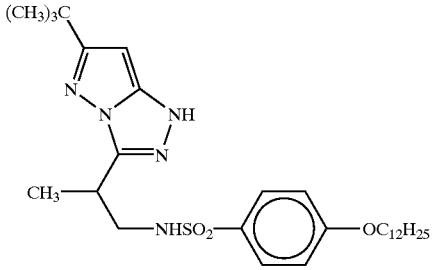
II-18.
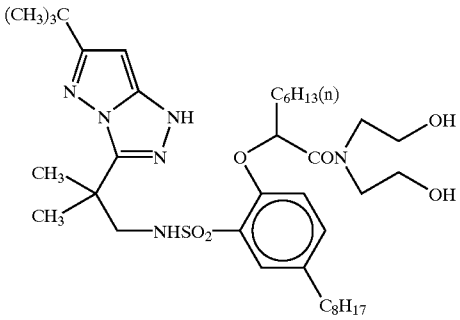
II-19.
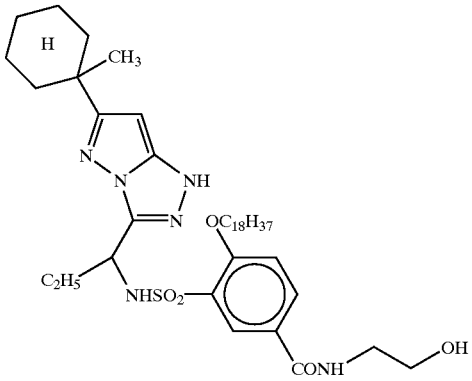
-continued
II-20.
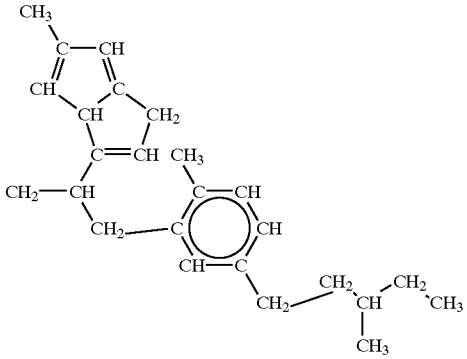
II-21.
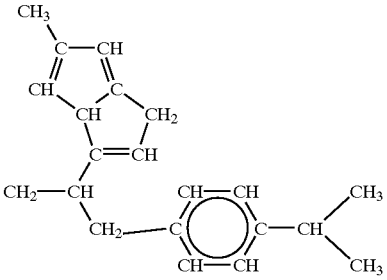
II-22.
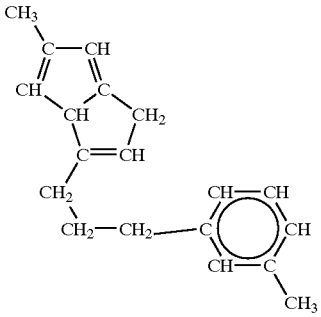
II-23.
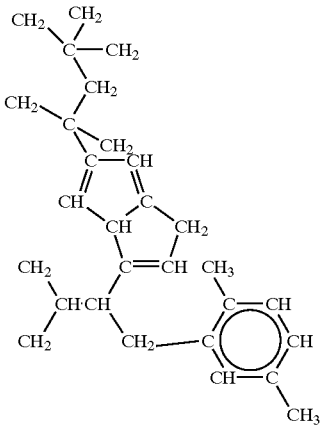
Hereinafter (t)$C_8H_{17}$-means
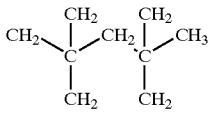

-continued

II-24.

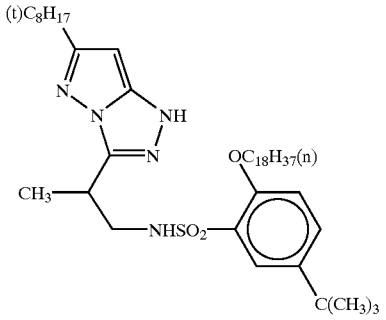

II-25.

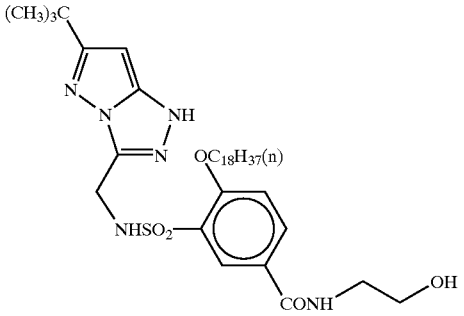

II-26.

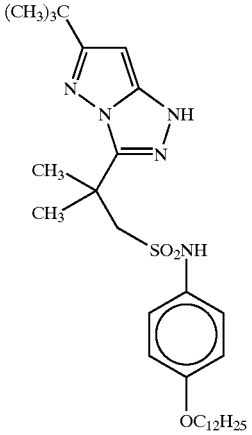

II-27.

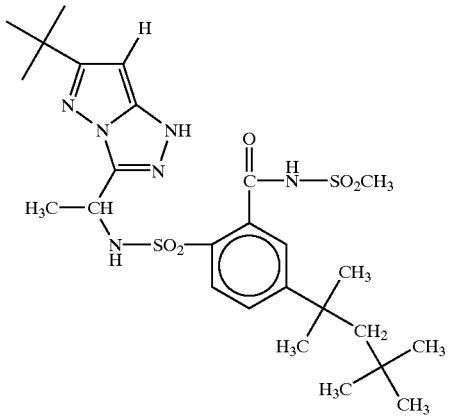

-continued

II-28.

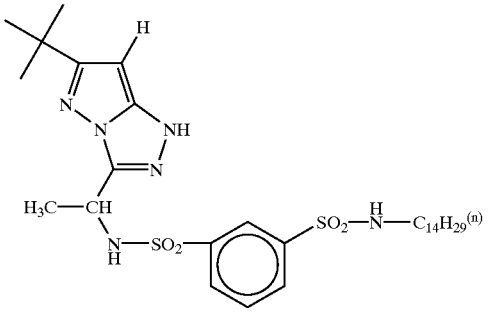

II-29.

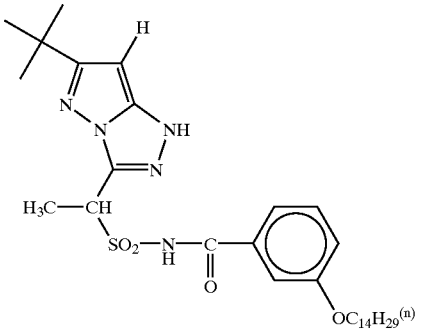

Couplers represented by formulas (1) and (2) of the present invention can be synthesized by known methods. Examples of the methods are described in U.S. Pat. Nos. 4,540,654, 4,705,863, and 5,451,501, JP-A-61-65245, JP-A-62-209457, JP-A-62-249155, JP-A-63-41851, Jpn. Pat. Appln. KOKOKU Publication No. (hereinafter referred to as JP-B-)7-122744, JP-B-5-105682, JP-B-7-13309, JP-B-7-82252, U.S. Pat. Nos. 3,725,067 and 4,777,121, JP-A-2-201442, JP-A-2-101077, JP-A-3-125143, and JP-A-4-242249, the disclosures of which are incorporated herein by reference.

Couplers represented by formulas (1) and (2) of the present invention can be introduced to a sensitive material by various known dispersion methods. Of these methods, an oil-in-water dispersion method is preferred in which couplers are dissolved in a high-boiling organic solvent (used in combination with a low-boiling solvent where necessary), the solution is dispersed by emulsification in an aqueous gelatin solution, and the dispersion is added to a silver halide emulsion.

Examples of the high-boiling solvent used in this oil-in-water dispersion method are described in, e.g., U.S. Pat. No. 2,322,027, the disclosure of which is incorporated herein by reference. Practical examples of steps, effects, and impregnating latexes of a latex dispersion method as one polymer dispersion method are described in, e.g., U.S. Pat. No. 4,199,363, West German Patent Application (OLS) Nos. 2,541,274 and 2,541,230, JP-B-53-41091, and European Patent Publication No. 029104, the disclosures of which are incorporated herein by reference. Dispersion using an organic solvent-soluble polymer is described in PCT International Publication WO88/00723, the disclosure of which is incorporated herein by reference.

Examples of the high-boiling solvent usable in the above-mentioned oil-in-water dispersion method are phthalic acid esters (e.g., dibutylphthalate, dioctylphthalate, dicyclohexylphthalate, di-2-ethylhexylphthalate, decylphthalate, bis(2,4-di-tert-amylphenyl)isophthalate, and bis(1,1-diethylpropyl)phthalate), esters of phosphoric acid and phosphonic acid (e.g., diphenylphosphate, triphenylphosphate, tricresylphosphate, 2-ethylhexyldiphenylphosphate, dioctylbutylphosphate, tricyclohexylphosphate, tri-2-ethylhexylphosphate, tridodecylphosphate, and di-2-ethylhexylphenylphosphate), benzoic acid esters (e.g., 2-ethylhexylbenzoate, 2,4-dichlorobenzoate, dodecylbenzoate, and 2-ethylhexyl-p-hydroxybenzoate), amides (e.g., N,N-diethyldodecaneamide and N,N-diethyllaurylamide), alcohols and phenols (e.g., isostearyl alcohol and 2,4-di-tert-amylphenol), aliphatic esters (e.g., dibutoxyethyl succinate, di-2-ethylhexyl succinate, 2-hexyldecyl tetradecanate, tributyl citrate, diethylazelate, isostearyllactate, and trioctyltosylate), aniline derivatives (e.g., N,N-dibutyl-2-butoxy-5-tert-octylaniline), chlorinated paraffins (paraffins containing 10% to 80% of chlorine), trimesic acid esters (e.g., trimesic acid tributyl), dodecylbenzene, diisopropylnaphthalene, phenols (e.g., 2,4-di-tert-amylphenol, 4-dodecyloxyphenol, 4-dodecyloxycarbonylphenol, and 4-(4-dodecyloxyphenylsulfonyl)phenol), carboxylic acids (e.g., 2-(2,4-di-tert-amylphenoxy)butyric acid and 2-ethoxyoctanedecanoic acid), and alkylphosphoric acids (e.g., di-(2-ethylhexyl)phosphoric acid and diphenylphosphoric acid). In addition to the above high-boiling solvents, compounds described in, e.g., JP-A-6-258803 can also be preferably used as high-boiling solvents, the disclosure of which is incorporated herein by reference.

Of these compounds, phosphoric acid esters are preferred, and the combination of phosphoric acid esters with alcohols or phenols is also preferred.

The weight ratio of a high-boiling organic solvent to couplers represented by formulas (1) and (2) of the present invention is preferably 0 to 2.0, more preferably, 0.01 to 1.0, and most preferably, 0.01 to 0.5.

As a co-solvent, it is also possible to use an organic solvent (e.g., ethyl acetate, butyl acetate, ethyl propionate, methylethylketone, cyclohexanone, 2-ethoxyethylacetate, and dimethylformamide) having a boiling point of 30° C. to about 160° C.

The total content of couplers represented by formulas (1) and (2) of the present invention in a sensitive material is 0.01 to 10 g per $m^2$, preferably 0.1 g to 2 g per $m^2$. The content is suitably $1\times10^{-3}$ to 1 mol, preferably $2\times10^{-3}$ to $3\times10^{-1}$ mol per mol of a silver halide in the same sensitive emulsion layer.

When a sensitive layer has a unit configuration including two or more sensitive emulsion layers differing in sensitivity, the total content of couplers of the present invention per mol of a silver halide is preferably $2\times10^{-3}$ to $1\times10^{-1}$ mol in a low-speed layer and $3\times10^{-2}$ to $3\times10^{-1}$ mol in a high-speed layer.

A sensitive material of the present invention preferably contains couplers represented by formulas (1) and (2) in all sensitive emulsion layers differing in sensitivity.

A sensitive material of the present invention contains couplers represented by formulas (1) and (2) together in the same sensitive emulsion layer.

The molar ratio of couplers represented by formulas (1) and (2) of the present invention is preferably 1:9 to 9:1, more preferably, 1:9 to 7:3, and most preferably, 2:8 to 5:5.

The present invention is characterized by containing magenta couplers represented by formulas (1) and (2). Although another magenta coupler can also be used together with these couplers, the results become more preferable as the ratio which color dyes of couplers represented by formulas (1) and (2) of the present invention occupy in the contribution to the total magenta density increases. More specifically, the amount is such that the molar ratio of the magenta couplers of the present invention to total magenta couplers is preferably 50% or more, and more preferably, 70% or more.

A sensitive material of the present invention can also contain a competing compound (a compound which competes with an image forming coupler to react with the oxidized form of a color developing agent and which does not form any dye image). Examples of this competing compound are reducing compounds such as hydroquinones, catechols, hydrazines, and sulfonamidophenols, and compounds which couple with the oxidized form of a color developing agent but do not substantially form a color image (e.g., non-dye-forming couplers disclosed in German Patent No. 1,155,675, British Patent No. 861,138, and U.S. Pat. Nos. 3,876,428 and 3,912,513, and flow-out couplers disclosed in JP-A-6-83002, all the disclosures of which are incorporated herein by reference).

A competing compound is preferably added to a sensitive emulsion layer containing magenta couplers represented by formulas (1) and (2) of the present invention or to a non-sensitive layer. A competing compound is particularly preferably added to a sensitive emulsion layer containing couplers represented by formulas (1) and (2) of the present invention. The content of a competing compound is 0.01 to 10 g, preferably 0.10 to 5.0 g per $m^2$ of a sensitive material. The content is 1 to 1,000 mol %, preferably 20 to 500 mol % with respect to couplers of the present invention.

In a sensitive material of the present invention, a sensitive unit having the same color sensitivity can have a non-color-generating interlayer between layers of the sensitive unit. Additionally, this interlayer preferably contains a compound selectable as the aforementioned competing compound.

To prevent deterioration of the photographic properties caused by formaldehyde gas, a sensitive material of the present invention preferably contains a compound described in U.S. Pat. No. 4,411,987 or U.S. Pat No. 4,435,503, which can react with and fix formaldehyde gas, the disclosures of which are incorporated herein by reference.

A sensitive material of the present invention preferably has at least one green-sensitive emulsion layer containing couplers represented by formulas (1) and (2) of the present invention. A support can be coated with at least one blue-sensitive silver halide emulsion layer, at least one green-sensitive silver halide emulsion layer, and at least one red-sensitive silver halide emulsion layer in this order, but the order can also be changed. When the present invention is applied to a color reversal sensitive material, it is preferable to form red-, green-, and blue-sensitive silver halide emulsion layers in this order from the one closest to a support. Each color-sensitive layer preferably has a unit configuration including two or more sensitive emulsion layers different in sensitivity. Most preferably, each color-sensitive layer has a three-layered unit configuration including three sensitive emulsion layers, i.e., low-, medium-, and high-speed layers, formed in this order from the one closest to a support.

A sensitive material of the present invention can be developed by a normal development process. The pH of a color developer used in this development is 9.5 or more. The effect of the present invention is most significantly achieved when the pH of the color developer is 11.0 or more.

Development process preferably used in the present invention will be described below.

Known developing agents can be used in a first black-and-white developer and its replenisher used in the present invention. Examples of the developing agents are dihydroxybenzenes (e.g., hydroquinone and hydroquinonemonosulfonate), 3-pyrazolidones (e.g., 1-phenyl-3-pyrazolidone), aminophenols, ascorbic acid, and a heterocyclic compound described in U.S. Pat. No. 4,067,872, which is formed by condensing a 1,2,3,4-tetrahydroquinoline ring and an indolene ring, the disclosure of which is incorporated herein by reference. These materials can be used singly or in the form of a combination thereof. The developing agent is preferably potassium hydroquinonemonosulfonate or sodium hydroquinonemonosulfonate.

A preservative used in the first black-and-white developer/replenisher of the present invention is preferably sulfite and bisulfite. The sulfurous acid concentration in the developer is 0.01 to 10 mol/liter, preferably 0.1 to 1 mol/liter. Hydroxylamines represented by formula (I) of JP-A-3-144446 can also be used, the disclosure of which is incorporated herein by reference.

The first black-and-white developer/replenisher of the present invention can also contain a buffering agent (e.g., carbonate, borate, alkanolamine, and sulfosalicylic acid), hydroxide (e.g., potassium hydroxide and sodium hydroxide), dissolution aid (e.g., polyethyleneglycols), sensitizer (e.g., quaternary ammonium salt), silver halide solvent (e.g., KSCN and NaSCN), development accelerator, surfactant, and film hardener.

The pH of the first black-and-white developer/replenisher of the present invention is preferably 8.0 and 11.0, more preferably, 9.0 to 10.5, and most preferably, 9.5 and 10.0.

The standard processing time of the first black-and-white developer of the present invention is 6 min. Sensitization and desensitization can be performed by appropriately changing the processing time. Usually, the processing time is changed between 3 to 18 min.

The replenishment rate of the first black-and-white developer is generally 2 to 2.5 liters per $m^2$ of a sensitive material to be processed. Recently, processing using a replenishment rate of 0.5 to 1.5 liters is also performed to reduce the waste solution amount.

Oxidation deterioration can be prevented by decreasing the areas of contact of the solutions contained in the processing solution tank and the replenisher tank with air. The areas of contact of the photographic processing solutions in the processing tank and the replenisher tank with air can be represented by an aperture defined below.

aperture=[area ($cm^2$) of contact of processing solution with air]÷[volume ($cm^3$) of processing solution]

This aperture is preferably 0.1 or less, and more preferably, 0.001 to 0.05. In order to reduce the aperture, shielding members such as floating covers can be provided on the surfaces of the photographic processing solutions in the processing tank and the replenisher tank. It is also possible to use a method of using a movable cover described in JP-A-1-82033 and a slit developing method described in JP-A-63-216050, all the disclosures of which are incorporated herein by reference. Reducing the aperture is preferably applied to all processing steps, i.e., not only to the color and black-and-white development steps but also to the individual subsequent steps, e.g., bleaching, bleach-fixing, fixing, washing, and stabilizing steps. In addition, the replenishment rate can also be reduced by using a means for suppressing storage of bromide ions in the developer.

A reversal bath or an optical fogging step conventionally used after the first black-and-white development can be omitted in the present invention. However, when this step is performed, the reversal bath can contain known fogging agents. Examples of the fogging agents are stannous ion complex salts such as stannous ion-organic phosphoric acid complex salt (U.S. Pat. No. 3,617,282), stannous ion-organic phosphonocarboxylic acid complex salt (JP-B-56-32616), and stannous ion-aminopolycarboxylic acid complex salt (U.S. Pat. No. 1,209,050), and boron compounds such as a boron hydride compound (U.S. Pat. No. 2,984,567) and a heterocyclic amineborane compound (British Patent No. 1,011,000), all the disclosures of which are incorporated herein by reference. The pH of this reversal bath covers a wide range from an acidic side to an alkaline side. The pH is 2 to 12, preferably 2.5 to 10, and most preferably, 3 to 9.

In the present invention, a color developer contains aromatic primary amine color developing agents. The use amount of these color developing agents is preferably 1 to 20 g, and more preferably, 2 to 15 g per liter of the color developer.

These color developing agents can be used singly or in the form of a combination of two or more types thereof. Practical compounds will be described below, but the color developing agents are not limited to these compounds.

| | |
|---|---|
| D-1 | N,N-diethyl-p-phenylenediamine |
| D-2 | 2-amino-5-diethylaminotoluene |
| D-3 | 2-amino-5-(N-ethyl-N-laurylamino)toluene |
| D-4 | 4-[N-ethyl-N-(β-hydroxyethyl)amino]aniline |
| D-5 | 2-methyl-4-[N-ethyl-N-(β-hydroxyethyl)amino]aniline |
| D-6 | 4-amino-3-methyl-N-ethyl-N-[β-(methanesulfonamido)ethyl]-aniline |
| D-7 | N-(2-amino-5-diethylaminophenylethyl)methanesulfonamide |
| D-8 | N,N-dimethyl-p-phenylenediamine |
| D-9 | 4-amino-3-methyl-N-ethyl-N-methoxyethylaniline |
| D-10 | 4-amino-3-methyl-N-ethyl-N-β-ethoxyethylaniline |
| D-11 | 4-amino-3-methyl-N-ethyl-N-β-butoxyethylaniline |

These color developing agents are commonly used in the forms of salts such as hydrochloride, sulfate, phosphate, and p-toluenesulfonate, or in the form of a hydrate of salt.

Preferred color developing agents in the present invention are D-4, D-5, and D-6.

In the present invention, it is possible, where necessary, to add, as preservatives, to the color developer a sulfite such as sodium sulfite, potassium sulfite, sodium bisulfite, potassium bisulfite, sodium metasulfite, and potassium metasulfite, and a carbonyl compound sulfite adduct. The addition amount of the preservatives is preferably 20 g or less, more preferably, 10 g or less, and most preferably, 0.05 to 5 g per liter of the color developer.

In the present invention, the color developer can contain non-dye-forming competing couplers to adjust the gradation of a color image. Non-dye-forming competing couplers are described in U.S. Pat. Nos. 2,742,832, 3,520,690, and 3,645,737, JP-B-44-9504, JP-B-44-9506, and JP-B-44-9507, the disclosures of which are incorporated herein by reference. Examples of compounds most preferably used as non-dye-forming competing couplers are citrazinic acid, J acid, H acid, and resorcin. Of these compounds, citrazinic acid is particularly favorable. When a non-dye-forming competing coupler is added to the color developer, the addition amount is 1 to 10 mmol/liter.

In the present invention, it is unpreferable to use hydroxylamine as a preservative. This is so because hydroxylamine is unsuited to the color developer because hydroxylamine has non-color-generating development activity, and hence no desirable photographic properties (gradation) can be obtained. Other examples of a color developer preservative are sulfinic acids, α-hydroxyketones and α-aminoketones described in JP-A-63-44656, various sugars described in JP-A-63-36244, monoamines described in JP-A-63-4235, JP-A-63-24254, JP-A-63-21647, JP-A-63-146040, JP-A-63-27841, and JP-A-63-25654, diamines described in JP-A-63-30845, JP-A-63-146040, and JP-A-63-43439, polyamines described in JP-A-63-21647 and JP-A-63-26655, polyamines described in JP-A-63-44655, alcohols described in JP-A-63-43140 and JP-A-63-53549, oximes described in JP-A-63-56654, and tertiary amines described in JP-A-63-239447, all the disclosures of which are incorporated herein by reference.

As other preservatives, it is possible to add, if necessary, various metals described in JP-A-57-44148 and JP-A-57-53749, salicylic acids described in JP-A-59-180588, alkanolamines described in JP-A-54-3532, polyethyleneimines described in JP-A-56-94349, and aromatic polyhydroxy compounds described in U.S. Pat. No. 3,746,544, all the disclosures of which are incorporated herein by reference.

The color developer used in the present invention can contain compounds of other known developer components.

To maintain the pH range described above, the color developer used in the present invention contains an appropriate alkali agent and pH buffering agent. As these alkali agent and pH buffering agent, it is possible to use carbonate such as sodium carbonate, potassium carbonate, sodium hydrogencarbonate, and potassium hydrogencarbonate, alkali hydroxide such as sodium hydroxide and potassium hydroxide, phosphate such as trisodium phosphate and dipotassium phosphate, borate such as potassium borate and sodium tetraborate, and organic acid salts such as dipotassium 5-sulfosalicylate and disodium 4-sulfosalicylate.

The addition amount of these alkali agents and buffering agents to the color developer is 0.01 to 0.5 mol/liter, preferably 0.01 to 0.2 mol/liter.

Various chelating agents can also be added to the color developer, as precipitation inhibitors for calcium or magnesium or to improve the stability of the color developer. organic acid compounds are preferable as the chelating agents, and examples are aminopolycarboxylic acids, organic phosphonic acids, and phosphonocarboxylic acids. Practical examples are nitrilotriacetic acid, diethylenetriaminepentaacetic acid, ethylenediaminetetraacetic acid, N,N-N-trimethylenesulfonic acid, ethylenediamine-N,N,N',N'-tetramethylenephosphonic acid, transcyclohexanediaminetetraacetic acid, 1,2-diaminopropanetetraacetic acid, hydroxyethyliminodiacetic acid, glycoletherdiaminetetraacetic acid, ethylenediamineorthohydroxyphenylacetic acid, 1-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and 1,2-dihydroxyoxybenzene-3,5-disulfonic acid. Two or more types of these chelating agents can be used together where necessary.

The addition amount of the chelating agents is preferably 0.01 to 20 g per liter of the color developer, and most preferably, 0.1 g to 10 g per liter of the color developer. Given development accelerators can be added to the color developer as needed. In particular, thioether-based fogging accelerators can be added in order to fully utilize the development activity. As the thioether-based fogging agents, thioether-based compounds described in, e.g., JP-B-37-16088, JP-B-37-5987, JP-B-38-7826, JP-B-44-12380, JP-B-45-9019, and U.S. Pat. No. 3,813,247 are used, the disclosures of which are incorporated herein by reference. In addition, an amine compound such as ethylenediamine is usable. Of these compounds, 3,6-dithiaoctane-1,8-diol is preferred. When a fogging agent is added to the color developer, the addition amount of the fogging agent is approximately 1 to 20 mmol/liter.

Processing can be performed when the replenishment rate of the color developer of the present invention is 40 to 4,000 ml/m$^2$. However, the replenishment rate is preferably as low as possible, provided that the developer is stable, because decreasing the replenishment rate can reduce the waste solution. The replenishment rate can be reduced to preferably 40 to 1,100 ml/m$^2$, and more preferably, 400 to 1,100 ml/m$^2$.

In the present invention, desilvering is performed by a processing solution having bleaching capacity after color development. In this desilvering, one or both of a bleaching solution and bleach-fix solution are used, and these processing solutions contain a bleaching agent. Examples of the bleaching agent are a compound of a multivalent metal such as iron(III), peroxides, quinones, and a nitro compound. Representative examples of the bleaching agent are bleaching agents of organic complex salts of iron(III), e.g., ethylenediaminetetraacetic acid, diethylenetriaminepentaacetic acid, cyclohexanediaminetetraacetic acid, methyliminodiacetic acid, glycoletherdiaminetetraacetic acid, and complex salt of ferric 1,3-propylenediaminetetraacetate described in JP-A-4-121739, page 4, the lower right column to page 5, the upper left column, carbamoyl-based bleaching agents described in JP-A-4-73647, bleaching agents with a heterocyclic ring described in JP-A-4-174432, bleaching agents such as complex salt of ferric N-(2-carboxyphenyl) iminodiacetate described in European Patent Publication No. 520457, bleaching agents such as complex salt of ferric ethylenediamine-N-2-carboxyphenyl-N,N',N'-triacetate described in European Patent Publication No. 530828A1, bleaching agents described in European Patent Publication No. 501479, bleaching agents described in JP-A-4-127145, and ferric aminopolycarboxylate or its salt described in JP-A-5-303186 and JP-A-3-144446, page 11, all the disclosures of which are incorporated herein by reference.

Complex salts of ferric(III) organic aminocarboxylate are particularly useful in both the bleaching solution and the bleach-fixing solution. The pH of the bleaching or bleach-fixing solution using these complex salts of ferric(III) organic aminocarboxylate is normally 4.0 to 8.0. In order to increase the processing speed, however, processing can also be performed at a lower pH.

In the processing bath having bleaching capacity in the present invention, a rehalogenating agent described in JP-A-3-144446, page 12, the disclosure of which is incorporated herein by reference, a pH buffering agent, known additives, aminopolycarboxylic acids, and organic phosphonic acids can be used in addition to the bleaching agent.

Also, in the present invention various bleaching accelerators can be added to the bleaching solution or its pre-bath (control solution). Examples of the bleaching accelerators are compounds having a mercapto group or disulfide group, described in U.S. Pat. No. 3,893,858, German Patent No. 1,290,821, British Patent No. 1,138,842, JP-A-53-95630, and Research Disclosure No. 17129 (July, 1978), a thiazolidine derivative described in JP-A-50-140129, a thiourea derivative described in U.S. Pat. No. 3,706,561, iodide described in JP-A-58-16235, polyethyleneoxides described in German Patent No. 2,748,430, and a polyamine compound described in JP-B-45-8836, all the disclosures of which are incorporated herein by reference. Compounds described in U.S. Pat. No. 4,552,834 are also preferable, the disclosure of which is incorporated herein by reference. These bleaching accelerators can also be added to sensitive materials. These bleaching accelerators are particularly effective when color sensitive materials for photography are bleach-fixed. The mercapto compounds described in British Patent No. 1,138,842 and JP-A-2-190856 are preferred, the disclosures of which are incorporated herein by reference.

The processing solutions (the bleaching solution and the bleach-fixing solution) having bleaching capacity preferably contains an organic acid, in addition to the above compounds, in order to prevent bleaching stains. A particularly preferred organic acid is a compound whose acid dissociation constant (pKa) is 2 to 5. Specific preferred examples of the compound are acetic acid, lactic acid, malonic acid, glutaric acid, succinic acid, propionic acid, and hydroxyacetic acid.

It is preferable that these organic acids be contained in an amount of 0.005 to 3 mols per liter of the processing solution having bleaching capacity. Although the bleaching process is preferably performed immediately after the color development, in the case of a reversal process the bleaching process is generally done via, e.g., a control solution (which can also be a bleaching accelerator).

As the control solution, it is possible to add various bleaching accelerators to be described later, e.g., aminopolycarboxylic acid chelating agents such as ethylenediaminetetraacetic acid, diethylenetriaminepentaacetic acid, 1,3-diaminopropanetetraacetic acid, and cyclohexanediaminetetraacetic acid; sulfites such as sodium sulfite and ammonium sulfite, and thioglycerin, aminoethanethiol, and sulfoethanethiol. Also, to prevent scum, it is preferable to add sorbitan esters of fatty acid substituted by ethyleneoxide, described in U.S. Pat. No. 4,839,262, and polyoxyethylene compounds described in U.S. Pat. No. 4,059,446 and Research Disclosure Vol. 191, 19104 (1980), all the disclosures of which are incorporated herein by reference. These compounds can be used in an amount of 0.1 to 20 g, preferably 1 to 5 g per liter of the control solution.

Image stabilizers to be described below also can be contained in the control solution. The pH of the control solution commonly ranges between 3 and 11, preferably 4 and 9, and more preferably, 4.5 and 7. The processing time in the control solution is preferably 20 sec to 15 min, more preferably, 20 sec to 100 sec, and most preferably, 20 sec to 60 sec. The replenishment rate of the control solution is preferably 30 to 3,000 ml, and most preferably, 50 to 1,500 ml per $m^2$ of a sensitive material. The processing temperature of the control solution is preferably 20° C. to 50° C., and most preferably, 30° C. to 40° C.

In the present invention, after the desilvering process is performed, processing can be performed in a stabilizing bath after washing or can be immediately performed using a stabilizer without performing washing. The amount of water used in the washing step can be set over a broad range in accordance with the characteristics (e.g., characteristics determined by materials used such as couplers) and the intended use of a sensitive material, the temperature of the water for washing, the number of washing tanks (the number of stages), a replenishing system such as in a counter-current flow or co-current flow, and other various conditions. The relationship between the amount of water and the number of washing tanks in a multi-stage counter-current flow system can be obtained by a method described in "Journal of the Society of Motion Picture and Television Engineers", Vol. 64, pp. 248–253 (May, 1955), the disclosure of which is incorporated herein by reference. By the above-described multi-stage counter-current flow system, the amount of water for washing can be greatly decreased. Since washing water stays in the tanks for long periods of time, however, bacteria may propagate and floating substances generated from their propagation may be undesirably attached to a sensitive material. In order to solve this problem in the processing of the present invention, a method of decreasing calcium and magnesium ions can be effectively utilized, as described in JP-A-62-288838, the disclosure of which is incorporated herein by reference. Also, it is preferable to use a germicide such as an isothiazolone compound and thiabendazoles described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986), all the disclosures of which are incorporated herein by reference.

As the stabilizer of the present invention, a stabilizer containing formaldehyde is common. Additionally, it is possible to use known stabilizers and processing methods described in U.S. Pat. Nos. 4,786,583 and 4,859,574, JP-A-3-33847, JP-A-4-270344, JP-A-4-313753, JP-A-4-359249, JP-A-5-34889, JP-A-5-165178, JP-A-57-8543, JP-A-58-14834, and JP-A-60-220345, the disclosures of which are incorporated herein by reference.

A compound (to be referred to as an image stabilizing agent hereinafter) for stabilizing a dye image is contained in the stabilizer or the control solution of the present invention. Examples of the image stabilizing agents are formalin, benzaldehydes such as m-hydroxybenzaldehyde, a formaldehyde bisulfite adduct, hexamethylenetetramine and its derivative, hexahydrotriazine and its derivative, dimethylol urea, and an N-methylol compound such as N-methylolpyrazole. In the present invention, the free formaldehyde concentration in the solution is preferably 0 to 0.01%, and more preferably, 0 to 0.005% because a great effect is obtained. Preferred image stabilizing agents by which this free formaldehyde concentration is attained are m-hydroxybenzaldehyde, hexamethylenetetramine, N-methylolazoles such as N-methylolpyrazole described in JP-A-4-270344, and azolylmethylamines such as N,N'-bis(1,2,4-triazole-1-ylmethyl)piperazine described in JP-A-4-313753, all the disclosures of which are incorporated herein by reference.

The content of these image stabilizing agents is preferably 0.001 to 0.1 mol, and more preferably, 0.001 to 0.05 mol per liter of the stabilizer. The stabilizer of the present invention preferably contains various surfactants to prevent waterdrop variations during drying of a processed sensitive material. Examples of the surfactant are a,polyethyleneglycol type nonionic surfactant, polyvalent alcohol type nonionic surfactant, alkylbenzenesulfonate type anionic surfactant, higher alcohol sulfate type anionic surfactant, alkylnaphthalenesulfonate type anionic surfactant, quaternary ammonium salt type cationic surfactant, amine salt type cationic surfactant, amino salt type amphoteric surfactant, and betaine type amphoteric surfactant. Use of the nonionic surfactants is preferred, and particularly nonionic surfactants of alkylpolyethylene oxides, alkylphenoxypolyethylene oxides and alkylphenoxypolyhydroxypropylene oxides are preferred.

It is preferable that chelating agents for catching heavy metal be contained in the stabilizer of the present invention in order to improve the stability of the stabilizer and to reduce contamination. As chelating agents, the same compounds as added to the developer and the bleaching solution described above can be used. To prevent mildew and bacteria, it is preferable to add antibacterial and antifungal agents to the stabilizer of the present invention. For this purpose, commercially available antibacterial and antifungal agents can be used.

The pH of the stabilizer and the washing water of the present invention is 4 to 9, preferably 5 to 8. The processing temperature and the processing time also can be variously set in accordance with the characteristics and the intended use of a sensitive material. In general, the processing temperature and the processing time are 15 to 45° C. and 20 sec to 10 min, preferably 25 to 40° C. and 30 sec to 2 min, respectively. Furthermore, the contamination preventing effect of the stabilizer in the present invention significantly appears when processing is performed using the stabilizer immediately after the desilvering process without performing washing.

The replenishment rate of the stabilizer in the present invention is preferably 200 to 2,000 ml per $m^2$ of a sensitive material. The overflow solutions resulting from replenishment of the washing water and/or the stabilizer can also be reused in other steps such as the desilvering step.

To reduce the use amount of the washing water, ion exchange or ultrafiltration can be used. Use of ultrafiltration is particularly preferred. Various processing solutions in the present invention are used at 10° C. to 50° C. Although a temperature of 33° C. to 38° C. is usually a standard temperature, the processing time can be shortened by accelerating the processing by raising the temperature. Conversely, it is possible to improve the image quality or the stability of the processing solution by lowering the temperature.

A color reversal film to which a developing method of the present invention is applied will be described below. This film is a silver halide color photographic lightsensitive material in which sensitive units are usually arranged in the order of red-, green-, and blue-sensitive units from the one closest to a support, and which has one or more non-color-generating layers at least between the red- and green-sensitive units or between the green- and blue-sensitive units.

In a sensitive material in which a sensitive unit has a three-layered configuration, low-, medium-, and high-speed emulsion layers are preferably formed by coating in this order from the one closest to a support. Between these sensitive emulsion layers, a non-color-generating interlayer or a layer containing a silver halide emulsion can be formed by coating.

All of blue-, green-, and red-sensitive units preferably have a three-layered configuration. However, a blue-sensitive layer can have two or less layers, and green- and red-sensitive layers can have a three-layered configuration.

Blue-, green-, and red-sensitive layers contain yellow, magenta, and cyan couplers, respectively. However, couplers of other combinations can also be mixed to control the color reproduction.

In a unit of a three-layered configuration, the coating amount of a silver halide emulsion is preferably distributed at ratios of 10% to 60%, 10% to 50%, and 30% to 70% in high-, medium-, and low-speed layers, respectively, with respect to the silver halide emulsion coating weight of the entire unit. Also, the silver/coupler ratio in each sensitive layer is preferably a maximum in a low-speed layer.

A non-color-generating interlayer is preferably formed between units sensitive to different colors. This non-color-generating interlayer can contain a sensitive, non-sensitive, or previously fogged silver halide emulsion.

An interlayer particularly preferably includes two to five layers. When this is the case, a layer farther from a support preferably contains colloidal silver grains or silver halide emulsion grains whose surfaces or interiors are previously fogged. When an interlayer contains silver halide emulsion, a color amalgamation inhibitor is preferably added to the interlayer or a layer adjacent to it.

A more preferred embodiment of a color reversal film according to the present invention is as follows.

Red-, green-, and blue-sensitive units are formed by coating in this order from the one closest to a support. At least the red- and green-sensitive units include three sensitive emulsion layers, and these three layers are formed by coating in the order of low-, medium-, and high-speed layers from the one closest to the support. In these sensitive layers, the silver/coupler ratio is the largest in the low-speed layer. In particular, the silver/coupler ratio in the green-sensitive emulsion layer having the highest luminosity of color image is preferably 25 to 150. In this case, the silver/coupler ratio in the medium-speed layer is preferably 5 to 30, and the silver/coupler ratio in the high-speed layer is preferably 2 to 20.

Furthermore, interlayers each including two to five layers are formed between the red- and green-sensitive units and between the green- and blue-sensitive layers. A layer adjacent to the former green-sensitive layer and a layer adjacent to the latter blue-sensitive layer contain colloidal silver grains or a previously fogged silver halide emulsion. The total film thickness of the two interlayers is preferably 0.5 to 5 $\mu$m, and more preferably, 1.0 to 3.0 $\mu$m. Theoretically, this film thickness can be easily obtained from the specific gravities of additives. The film thickness of an actual coated product can be readily measured by observation of its section with an electron microscope.

In addition, an antihalation layer and an interlayer are formed closer to the support than the red-sensitive unit. At least one protective layer is formed farther from the support than the blue-sensitive unit. A least one of the protective layers preferably contains a silver halide emulsion.

In silver halide photographic emulsions used in the present invention and silver halide photographic lightsensitive materials using these emulsions, it is generally possible to use various techniques and inorganic and organic materials described in Research Disclosure Nos. 308119 (1989), 37038 (1995), and 40145 (1997), the disclosures of which are incorporated herein by reference.

In addition, and more specifically, techniques and inorganic and organic materials usable in color photographic lightsensitive materials are described in portions of EP436, 938A2 and patents cited below, the disclosures of which are incorporated herein by reference.

| Items | Corresponding portions |
|---|---|
| 1) Layer configurations | page 146, line 34 to page 147, line 25 |
| 2) Silver halide emulsions usable together | page 147, line 26 to page 148 line 12 |
| 3) Yellow couplers usable together | page 137, line 35 to page 146, line 33, and page 149, lines 21 to 23 |

-continued

| Items | Corresponding portions |
|---|---|
| 4) Magenta couplers usable together | page 149, lines 24 to 28; EP421, 453A1, page 3, line 5 to page 25, line 55 |
| 5) Cyan couplers usable together | page 149, lines 29 to 33; EP432, 804A2, page 3, line 28 to page 40, line 2 |
| 6) Polymer couplers | page 149, lines 34 to 38; EP435, 334A2, page 113, line 39 to page 123, line 37 |
| 7) Colored couplers | page 53, line 42 to page 137, line 34, and page 149, lines 39 to 45 |
| 8) Functional couplers usable together | page 7, line 1 to page 53, line 41, and page 149, line 46 to page 150, line 3; EP435, 334A2, page 3, line 1 to page 29, line 50 |
| 9) Antiseptic and antifungal agents | page 150, lines 25 to 28 |
| 10) Formalin scavengers | page 149, lines 15 to 17 |
| 11) Other additives usable together | page 153, lines 38 to 47; EP421, 453A1, page 75, line 21 to page 84, line 56, and page 27, line 40 to page 37, line 40 |
| 12) Dispersion methods | page 150, lines 4 to 24 |
| 13) Supports | page 150, lines 32 to 34 |
| 14) Film thickness film physical properties | page 150, lines 35 to 49 |
| 15) Color development step | page 150, line 50 to page 151, line 47 |
| 16) Desilvering step | page 151, line 48 to page 152, line 53 |
| 17) Automatic processor | page 152, line 54 to page 153, line 2 |
| 18) Washing.stabilizing step | page 153, lines 3 to 37 |

The present invention will be described below by way of its examples, but the invention is not limited to these examples.

EXAMPLE 1

Making of Sample 101

A color sensitive material including two layers having the following compositions was formed on an undercoated cellulose triacetate film support to make sample 101. The numbers represent addition amounts per $m^2$. The amount of a silver halide is indicated by a silver amount.

| 1st layer: Green-sensitive emulsion layer | | |
|---|---|---|
| Silver iodobromide silver monodisperse tabular grains | | 2.00 g |
| average equivalent-sphere grain size | 0.3 μm | |
| variation coefficient | 18% | |
| AgI content | 4.0 mol % | |
| Gelatin | | 3.50 g |
| Coupler C-1 | | 0.45 g |
| High-boiling organic solvent Oil-1 | | 0.45 g |

-continued

| 2nd layer: Protective layer | |
|---|---|
| Gelatin | 2.00 g |
| Polymethylmethacrylate (average grain size 2.0 μm) | 0.10 g |
| Surfactant W-1 | 0.15 g |
| Gelatin hardener H-1 | 0.17 g |

C-1

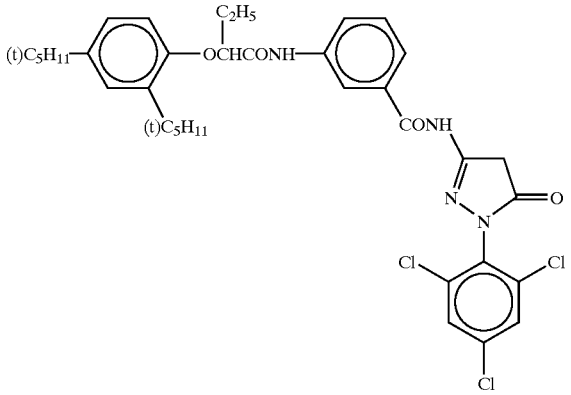

Oil-1
Tricresyl phosphate

W-1

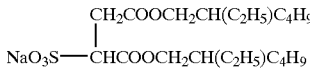

H-1

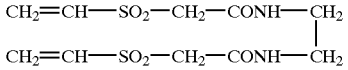

Making of Samples 102–117

Samples 102 to 117 were made following the same procedures as for sample 101 except that the magenta coupler in the first layer of sample 101 was replaced as shown in Table 1. Since the molar absorption coefficient of a pyrazolotriazole-based coupler is higher than that of a pyrazolone-based coupler, the addition amount of the pyrazolotriazole-based coupler was a 0.6-fold molar quantity of the coupler C-1.

Comparative coupler (A)

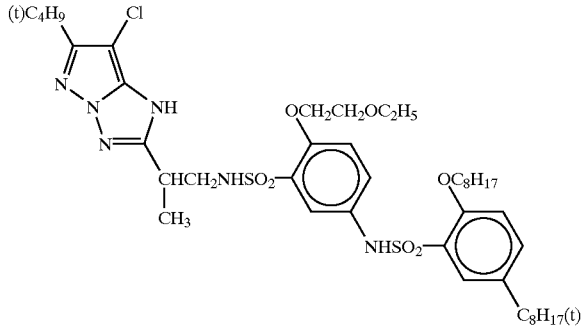

-continued

Comparative coupler (B)

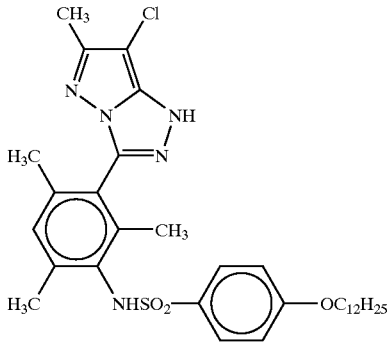

Comparative coupler (A) and (B) are magenta couplers described in JP-A-4-346342.

methanesulfonamidoethyl)-3-methyl-4-amino aniline.3/2 sulfuric acid.monohydrate] in color developer was adjusted to 5.0 and 13.0 g per liter. The dependence on addition amount was evaluated by the following equation by measuring the magenta density in processing in which the amount of the color developing agent was 5.0 g per liter for the same exposure amount as giving a magenta density of 1.0 in processing in which the amount of the color developing agent was 13.0 g per liter.

(1.0−density in processing in which amount of color developing agent was 5.0 g/L)×100=change rate (%)

The smaller the value of the change rate, the smaller the change in the color density with a variation in the color developing agent.

Granularity: After being given step exposure, each sample was subjected to the following development, and the RMS granularity of the sample at a magenta image density of 0.5 was measured. The measurement aperture was 48 $\mu$m$\phi$, and each measurement value was multiplied by 1,000. The smaller the value, the higher the granularity.

TABLE 1

| Sample No. | Magenta couplers Types | Ratio | Dependence on pH of color developer | Dependence on addition amount of color developing agent | Granularity × 1000 | Yellow stain |
|---|---|---|---|---|---|---|
| 101 (Comparative example) | C-1 | — | −16 | 6 | 3.6 | 0.07 |
| 102 (Comparative example) | I-5 | — | −32 | 26 | 6.1 | 0.01 |
| 103 (Comparative example) | I-18 | — | −26 | 31 | 4.2 | 0.13 |
| 104 (Comparative example) | II-13 | — | +14 | 11 | 5.6 | 0.02 |
| 105 (Comparative example) | II-4 | — | +18 | 8 | 4.5 | 0.06 |
| 106 (Comparative example) | Comparative coupler A/B | 4/6 | −10 | 15 | 6.0 | 0.02 |
| 107 (Present invention) | I-18/II-13 | 5/5 | −7 | 9 | 4.4 | 0.03 |
| 108 (Present invention) | I-18/II-4 | 5/5 | −3 | 6 | 3.7 | 0.04 |
| 109 (Present invention) | I-5/II-4 | 5/5 | −3 | 4 | 4.1 | 0.01 |
| 110 (Present invention) | I-5/II-4 | 3/7 | +2 | 1 | 3.8 | 0.01 |
| 111 (Present invention) | I-5/II-8 | 3/7 | +1 | 0 | 3.9 | 0.01 |
| 112 (Present invention) | I-5/II-11 | 3/7 | 0 | 0 | 3.7 | 0.01 |
| 113 (Present invention) | I-5/II-18 | 3/7 | +1 | 1 | 3.9 | 0.01 |
| 114 (Present invention) | I-5/II-24 | 3/7 | +5 | 8 | 4.0 | 0.02 |
| 115 (Present invention) | I-14/II-8 | 3/7 | +2 | 1 | 3.9 | 0.02 |
| 116 (Present invention) | I-17/II-8 | 3/7 | +1 | 2 | 3.9 | 0.01 |
| 117 (Present invention) | I-21/11-8 | 3/7 | +1 | 1 | 3.8 | 0.01 |

Evaluation of dependence on pH of color developer: Each sample obtained in Example 1 was exposed to white light at a color temperature of 4,800 K through a wedge having a continuously changing density and subjected to the following development, and the magenta density of the sample was measured. The processing was performed by adjusting the pH of the color developer to 11.5 and 12.1 by taking account of variations in laboratories on the market. The dependence on pH was evaluated by the following equation by measuring the magenta density in processing at pH 12.1 for the same exposure amount as giving a magenta density of 1.0 in processing at pH 11.5.

(density in processing at pH 12.1−1.0)×100=change rate (%)

The smaller the value of the change rate, the smaller the change in the color density with a pH variation in the color developer. When the change rate is +, the color density at pH 12.1 is high; when the change rate is −, the color density is low.

Evaluation of dependence on addition amount of color developing agent: The contents of development were the same as the following development except that the amount of color developing agent [N-ethyl-N(β-

Evaluation of yellow stains: Each sample was exposed to white light at 500 lux for one second and subjected to the following development. Each resultant sample was stored in a 60° C. 70%RH atmosphere for four weeks, and the yellow stain density was measured. Yellow stains were evaluated by the value calculated by subtracting the blank density from the increased yellow density. The smaller the value, the less the generation of yellow stains.

Table 1 shows the above results.

Sample 101 using the conventional pyrazolone magenta coupler had high granularity but increased the generation of yellow stains and the dependence on pH variations in the color developer. Also, each of samples 102 to 105 using the pyrazolotriazole magenta couplers of the present invention alone increased the dependence on pH variations in the color developer. In particular, the dependence of each of samples 104 and 105 changed in the opposite direction. Also, samples 102 and 104 using couplers of the present invention alone, having a split-off group except for a hydrogen atom at the coupling position, significantly deteriorated the granulariry, so no satisfactory results were obtained. Sample 106 using a coupler described in Example 1 of JP-A-4-

346342 which is a technique close to the present invention improved the dependence on pH variations in the color developer to some extent but significantly deteriorated the granularity. The dependence on the addition amount of the color developing agent was also unsatisfactory. In contrast to these samples, samples 107 to 117 of the present invention had small dependence on pH variations in the color developer and also achieved a remarkable effect in the performance of other items. This effect is obviously a new effect rather than the effect of combination by simple mixture. Of the samples of the present invention, samples 108 to 113 and 115 to 117 having dissociative substituents in a coupler represented by formula (4) accomplished the most favorable results.

(Processing)

| Processing Step | Time | Temperature | Tank volume | Replenishment rate |
|---|---|---|---|---|
| 1st development | 6 min | 38° C. | 12 L | 2,200 mL/m$^2$ |
| 1st washing | 2 min | 38° C. | 4 L | 7,500 mL/m$^2$ |
| Reversal | 2 min | 38° C. | 4 L | 1,100 mL/m$^2$ |
| Color development | 6 min | 38° C. | 12 L | 2,200 mL/m$^2$ |
| Pre-bleaching | 2 min | 38° C. | 4 L | 1,100 mL/m$^2$ |
| Bleaching | 6 min | 38° C. | 12 L | 220 mL/m$^2$ |
| Fixing | 4 min | 38° C. | 8 L | 1,100 mL/m$^2$ |
| 2nd washing | 4 min | 38° C. | 8 L | 7,500 mL/m$^2$ |
| Final rinsing | 1 min | 25° C. | 2 L | 1,100 mL/m$^2$ |

The compositions of the processing solutions were as follows.

| | <Tank solution> | <Replenisher> |
|---|---|---|
| **<1st developer>** | | |
| Nitrilo-N,N,N-trimethylene phosphonic acid. pentasodium salt | 1.5 g | 1.5 g |
| Diethylenetriamine pentaacetic acid. pentasodium salt | 2.0 g | 2.0 g |
| Sodium sulfite | 30 g | 30 g |
| Hydroquinone.potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | |
| Diethyleneglycol | 13 g | 15 g |
| Water to make | 1,000 mL | 1,000 mL |
| pH | 9.60 | 9.60 |
| The pH was adjusted by sulfuric acid or potassium hydroxide. | | |
| **<Reversal solution>** | | |
| Nitrilo-N,N,N-trimethylene phosphonic acid. pentasodium salt | 3.0 g | the same as tank solution |
| Stannous chloride.dihydrate | 1.0 g | the same as tank solution |
| p-aminophenol | 0.1 g | the same as tank solution |
| Sodium hydroxide | 8 g | the same as tank solution |
| Glacial acetic acid | 15 mL | the same as tank solution |
| Water to make | 1,000 mL | the same as tank solution |
| pH | 6.00 | the same as tank solution |
| The pH was adjusted by acetic acid or sodium hydroxide. | | |
| **<Color developer>** | | |
| Nitrilo-N,N,N-trimethylene phosphonic acid. pentasodium salt | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfonamidoethyl)-3-methyl-4-aminoaniline.3/2 sulfuric acid.monohydrate | 11 g | 11 g |
| 3,6-dithiaoctane-1,8-diol | 1.0 g | 1.0 g |
| Water to make | 1,000 mL | 1,000 mL |
| pH | 11.80 | 12.00 |
| The pH was adjusted by sulfuric acid or potassium hydroxide. | | |
| **<Pre-bleaching solution>** | | |
| Ethylenediaminetetraacetic acid.disodium salt. dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.30 | 6.10 |
| The pH was adjusted by acetic acid or sodium hydroxide. | | |
| **<Bleaching solution>** | | |
| Ethylenediaminetetraacetic acid.disodium salt. dihydrate | 2.0 g | 4.0 g |
| Ethylenediaminetetraacetic acid.Fe(III).ammonium. dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |
| The pH was adjusted by nitric acid or sodium hydroxide. | | |
| **<Fixing solution>** | | |
| Ammonium thiosulfate | 80 g | the same as tank solution |
| Sodium sulfite | 5.0 g | the same as tank solution |
| Sodium bisulfite | 5.0 g | the same as tank solution |
| Water to make | 1,000 mL | the same as tank solution |
| pH | 6.60 | the same as tank solution |
| The pH was adjusted by acetic acid or ammonia water. | | |
| **<Stabilizer>** | | |
| 1,2-benzoisothiazoline-3-one | 0.02 g | 0.03 g |
| Polyoxyethylene-p-monononylphenylether | 0.3 g | 0.3 g |

-continued

| (Processing) | | |
|---|---|---|
| (average polymerization degree = 10) | | |
| Polymaleic acid | 0.1 g | 0.15 g |
| (average molecular weight = 2,000) | | |
| Water to make | 1,000 mL | 1,000 mL |
| pH | 7.0 | 7.0 |

EXAMPLE 2

Making of Sample 201

A multilayered color sensitive material including layers having the following compositions was formed on a 127-μm thick undercoated cellulose triacetate film support to make sample 201. The numbers represent addition amounts per $m^2$. Note that the effects of added compounds are not restricted to the described purposes.

| | | |
|---|---|---|
| 1st layer: Antihalation layer | | |
| Black colloidal silver | | 0.13 g |
| Gelatin | | 2.00 g |
| Ultraviolet absorbent U-1 | | 0.20 g |
| Ultraviolet absorbent U-3 | | 0.040 g |
| Ultraviolet absorbent U-4 | | 0.15 g |
| High-boiling organic solvent Oil-2 | | 0.10 g |
| Dye D-4 | | 1.0 mg |
| Dye D-8 | | 2.5 mg |
| Fine crystal solid dispersion of dye E-1 | | 0.10 g |
| 2nd layer: Interlayer | | |
| Gelatin | | 0.40 g |
| Compound Cpd-C | | 0.5 mg |
| Compound Cpd-J | | 1.0 mg |
| Compound Cpd-K | | 2.5 mg |
| Compound Cpd-M | | 0.030 g |
| Ultraviolet absorbent U-6 | | 5.0 mg |
| High-boiling organic solvent Oil-3 | | 0.010 g |
| High-boiling organic solvent Oil-4 | | 0.020 g |
| High-boiling organic solvent Oil-5 | | 2.0 mg |
| High-boiling organic solvent Oil-7 | | 2.0 mg |
| High-boiling organic solvent Oil-8 | | 5.0 mg |
| Dye D-7 | | 2.5 mg |
| 3rd layer: Interlayer | | |
| Yellow colloidal silver | silver | 5 mg |
| Gelatin | | 0.40 g |
| Compound Cpd-M | | 0.010 g |
| High-boiling organic solvent Oil-3 | | 0.010 g |
| 4th layer: Low-speed red-sensitive emulsion layer | | |
| Emulsion A | silver | 0.25 g |
| Emulsion B | silver | 0.10 g |
| Emulsion C | silver | 0.20 g |
| Gelatin | | 0.70 g |
| Coupler C-2 | | 0.030 g |
| Coupler C-3 | | 0.020 g |
| Coupler C-4 | | 0.010 g |
| Coupler C-7 | | 5.0 mg |
| Coupler C-9 | | 0.050 g |
| Compound Cpd-C | | 5.0 mg |
| Compound Cpd-I | | 0.020 g |
| Compound Cpd-J | | 5.0 mg |
| High-boiling organic solvent Oil-1 | | 0.07 g |
| Additive P-1 | | 0.10 g |
| 5th layer: Medium-speed red-sensitive emulsion layer | | |
| Emulsion C | silver | 0.20 g |
| Emulsion D | silver | 0.15 g |
| Gelatin | | 0.60 g |
| Coupler C-2 | | 0.050 g |

-continued

| | | |
|---|---|---|
| Coupler C-3 | | 0.020 g |
| Coupler C-4 | | 0.010 g |
| Coupler C-9 | | 0.10 g |
| High-boiling organic solvent Oil-1 | | 0.10 g |
| Additive P-1 | | 0.10 g |
| 6th layer: High-speed red-sensitive emulsion layer | | |
| Emulsion E | silver | 0.15 g |
| Emulsion F | silver | 0.15 g |
| Gelatin | | 1.00 g |
| Coupler C-2 | | 0.10 g |
| Coupler C-3 | | 0.050 g |
| Coupler C-4 | | 0.20 g |
| Coupler C-9 | | 0.30 g |
| High-boiling organic solvent Oil-1 | | 0.10 g |
| High-boiling organic solvent Oil-9 | | 0.20 g |
| Compound Cpd-K | | 2.0 mg |
| Compound Cpd-F | | 0.050 g |
| Additive P-1 | | 0.10 g |
| 7th layer: Interlayer | | |
| Gelatin | | 0.50 g |
| Additive P-2 | | 0.30 g |
| Compound Cpd-I | | 2.6 mg |
| Dye D-5 | | 0.020 g |
| Dye D-6 | | 0.010 g |
| Compound Cpd-M | | 0.040 g |
| Compound Cpd-O | | 3.0 mg |
| Compound Cpd-P | | 2.5 mg |
| High-boiling organic solvent Oil-1 | | 0.020 g |
| High-boiling organic solvent Oil-6 | | 0.050 g |
| 8th layer: Interlayer | | |
| Fine grain silver iodobromide emulsion having fogged surface and interior (average grain size 0.06 μm, variation coefficient 18%, AgI content 1 mol %) | silver | 0.010 g |
| Yellow colloidal silver | silver | 7.0 mg |
| Gelatin | | 0.60 g |
| Additive P-1 | | 0.05 g |
| Compound Cpd-A | | 0.10 g |
| Compound Cpd-M | | 0.050 g |
| High-boiling organic solvent Oil-6 | | 0.10 g |
| 9th layer: Low-speed green-sensitive emulsion layer | | |
| Emulsion G | silver | 0.25 g |
| Emulsion H | silver | 0.30 g |
| Emulsion I | silver | 0.25 g |
| Gelatin | | 1.00 g |
| Coupler I-5 | | 0.14 g |
| Compound Cpd-B | | 0.030 g |
| Compound Cpd-D | | 0.020 g |
| Compound Cpd-E | | 0.020 g |
| Compound Cpd-G | | 2.5 mg |
| Compound Cpd-F | | 0.040 g |
| Compound Cpd-K | | 2.0 mg |
| Compound Cpd-L | | 0.020 g |
| High-boiling organic solvent Oil-1 | | 0.02 g |
| High-boiling organic solvent Oil-6 | | 0.05 g |
| 10th layer: Medium-speed green-sensitive emulsion layer | | |
| Emulsion I | silver | 0.20 g |
| Emulsion J | silver | 0.20 g |
| Gelatin | | 0.70 g |
| Coupler I-5 | | 0.13 g |
| Compound Cpd-B | | 0.030 g |
| Compound Cpd-D | | 0.020 g |
| Compound Cpd-F | | 0.050 g |
| Compound Cpd-G | | 2.0 mg |
| High-boiling organic solvent Oil-6 | | 0.060 g |
| 11th layer: High-speed green-sensitive emulsion layer | | |
| Emulsion K | silver | 0.55 g |
| Gelatin | | 0.80 g |
| Coupler I-5 | | 0.18 g |
| Compound Cpd-B | | 0.080 g |

-continued

| | | |
|---|---|---|
| Compound Cpd-D | | 0.020 g |
| Compound Cpd-F | | 0.040 g |
| Compound Cpd-K | | 5.0 mg |
| High-boiling organic solvent Oil-6 | | 0.09 g |
| 12th layer: Interlayer | | |
| Gelatin | | 0.30 g |
| Compound Cpd-M | | 0.05 g |
| High-boiling organic solvent Oil-3 | | 0.025 g |
| High-boiling organic solvent Oil-6 | | 0.025 g |
| 13th layer: Yellow filter layer | | |
| Yellow colloidal silver | silver | 5.0 mg |
| Gelatin | | 1.00 g |
| Compound Cpd-C | | 0.010 g |
| Compound Cpd-M | | 0.030 g |
| Compound Cpd-L | | 0.010 g |
| High-boiling organic solvent Oil-6 | | 0.020 g |
| Fine crystal solid dispersion of dye E-2 | | 0.030 g |
| Fine crystal solid dispersion of dye E-3 | | 0.020 g |
| 14th layer: Interlayer | | |
| Gelatin | | 0.40 g |
| 15th layer: Low-speed blue-sensitive emulsion layer | | |
| Emulsion L | silver | 0.20 g |
| Emulsion M | silver | 0.20 g |
| Gelatin | | 0.80 g |
| Coupler C-5 | | 0.20 g |
| Coupler C-6 | | 0.10 g |
| Coupler C-8 | | 0.10 g |
| Compound Cpd-I | | 0.010 g |
| Compound Cpd-M | | 0.010 g |
| 16th layer: Medium-speed blue-sensitive emulsion layer | | |
| Emulsion N | silver | 0.20 g |
| Emulsion O | silver | 0.20 g |
| Gelatin | | 0.90 g |
| Coupler C-5 | | 0.10 g |
| Coupler C-6 | | 0.10 g |
| Coupler C-8 | | 0.10 g |
| Compound Cpd-N | | 2.0 mg |
| Compound Cpd-K | | 2.0 mg |
| High-boiling organic solvent Oil-1 | | 0.050 g |
| 17th layer: High-speed blue-sensitive emulsion layer | | |
| Emulsion O | silver | 0.20 g |
| Emulsion P | silver | 0.25 g |
| Gelatin | | 1.20 g |
| Coupler C-5 | | 0.10 g |
| Coupler C-6 | | 0.10 g |
| Coupler C-8 | | 0.80 g |
| High-boiling organic solvent Oil-1 | | 0.10 g |
| Compound Cpd-N | | 5.0 mg |
| Compound Cpd-Q | | 0.20 g |
| 18th layer: 1st protective layer | | |
| Gelatin | | 0.70 g |
| Ultraviolet absorbent U-1 | | 0.20 g |
| Ultraviolet absorbent U-2 | | 0.050 g |
| Ultraviolet absorbent U-5 | | 0.30 g |
| Compound Cpd-O | | 5.0 mg |
| Compound Cpd-A | | 0.030 g |
| Compound Cpd-H | | 0.20 g |
| Dye D-1 | | 0.10 g |
| Dye D-2 | | 0.050 g |
| Dye D-3 | | 0.07 g |
| High-boiling organic solvent Oil-3 | | 0.10 g |
| 19th layer: 2nd protective layer | | |
| Colloidal silver | silver | 0.10 mg |
| Fine grain silver iodobromide emulsion (average grain size 0.06 μm, AgI content 1 mol %) | silver | 0.10 g |
| Gelatin | | 0.50 g |

-continued

| | |
|---|---|
| 20th layer: 3rd protective layer | |
| Gelatin | 0.80 g |
| Polymethylmethacrylate (average grain size 2.0 μm) | 0.10 g |
| 6:4 copolymer of methylmethacrylate and methacrylic acid (average grain size 1.5 μm) | 0.10 g |
| Silicone oil SO-1 | 0.10 g |
| Surfactant W-1 | 0.05 g |
| Surfactant W-2 | 3.0 mg |
| Surfactant W-3 | 3.0 mg |
| Surfactant W-7 | 0.015 g |

In addition to the above compositions, additives F-1 to F-10 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethyl alcohol, and p-benzoic butylester were added as antiseptic and antifungal agents.

The sensitive emulsions used in sample 201 are shown in Tables 2 to 4.

TABLE 2

Silver iodobromide emulsions used in sample 201 were as follows

| Emulsion | Characteristics | Average equivalent-sphere grain size (μm) | Variation coefficient (%) | AgI content (%) |
|---|---|---|---|---|
| A | Monodisperse tetra-dechadedral grain | 0.13 | 10 | 4.0 |
| B | Monodisperse cubic internal latent image type grain | 0.25 | 10 | 4.8 |
| C | Monodisperse tabular grain Average aspect ratio 2.0 | 0.30 | 15 | 3.8 |
| D | Monodisperse tabular grain Average aspect ratio 3.0 | 0.35 | 18 | 4.8 |
| E | Monodisperse tabular grain Average aspect ratio 3.0 | 0.40 | 15 | 2.0 |
| F | Monodisperse tabular grain Average aspect ratio 4.5 | 0.50 | 12 | 1.8 |
| G | Monodisperse cubic grain | 0.15 | 9 | 3.5 |
| H | Monodisperse cubic internal latent image type grain | 0.24 | 12 | 3.5 |
| I | Monodisperse tabular grain Average aspect ratio 4.0 | 0.30 | 17 | 3.5 |
| J | Monodisperse tabular grain Average aspect ratio 5.0 | 0.45 | 16 | 3.0 |
| K | Monodisperse tabular grain Average aspect ratio 5.5 | 0.60 | 13 | 3.3 |
| L | Monodisperse tetra-decahedral grain | 0.33 | 10 | 4.5 |
| M | Monodisperse cubic grain | 0.33 | 9 | 4.5 |
| N | Monodisperse tabular grain Average aspect ratio 3.0 | 0.43 | 10 | 2.5 |
| O | Monodisperse tabular grain Average aspect ratio 6.0 | 0.75 | 9 | 2.0 |
| P | Monodisperse tabular grain Average aspect | 0.90 | 8 | 1.8 |

TABLE 2-continued

Silver iodobromide emulsions used in sample 201 were as follows

| Emulsion | Characteristics | Average equivalent-sphere grain size (μm) | Variation coefficient (%) | AgI content (%) |
|---|---|---|---|---|
| | ratio 6.0 | | | |

TABLE 3

Spectral sensitization of emulsions A - P

| Emulsion name | Added sensitizing dye | Addition amount (g) per mol of silver halide |
|---|---|---|
| A | S-1 | 0.010 |
| | S-2 | 0.25 |
| | S-3 | 0.010 |
| | S-13 | 0.025 |
| B | S-2 | 0.25 |
| | S-8 | 0.015 |
| | S-13 | 0.025 |
| C | S-2 | 0.20 |
| | S-8 | 0.030 |
| | S-13 | 0.025 |
| D | S-1 | 0.030 |
| | S-2 | 0.15 |
| | S-3 | 0.020 |
| | S-13 | 0.10 |
| E | S-1 | 0.020 |
| | S-2 | 0.15 |
| | S-8 | 0.020 |
| | S-13 | 0.10 |
| F | S-1 | 0.020 |
| | S-2 | 0.15 |
| | S-8 | 0.10 |
| | S-13 | 0.025 |
| G | S-4 | 0.30 |
| | S-5 | 0.10 |
| | S-12 | 0.10 |
| H | S-4 | 0.20 |
| | S-12 | 0.10 |
| I | S-4 | 0.25 |
| | S-5 | 0.10 |
| | S-12 | 0.15 |

TABLE 4

Spectral sensitization of emulsions A - P

| Emulsion name | Added sensitizing dye | Addition amount (g) per mol of silver halide |
|---|---|---|
| J | S-4 | 0.40 |
| | S-9 | 0.10 |
| | S-12 | 0.15 |
| K | S-4 | 0.25 |
| | S-5 | 0.050 |
| | S-9 | 0.050 |
| | S-12 | 0.15 |
| L | S-6 | 0.25 |
| | S-7 | 0.15 |
| | S-10 | 0.050 |
| M | S-6 | 0.10 |
| | S-10 | 0.15 |
| | S-11 | 0.25 |
| N | S-10 | 0.25 |
| | S-11 | 0.25 |
| O | S-6 | 0.10 |
| | S-10 | 0.20 |
| | S-11 | 0.25 |

TABLE 4-continued

Spectral sensitization of emulsions A - P

| Emulsion name | Added sensitizing dye | Addition amount (g) per mol of silver halide |
|---|---|---|
| P | S-6 | 0.050 |
| | S-7 | 0.050 |
| | S-10 | 0.20 |
| | S-11 | 0.25 |

The compounds used in the formation of each layer of sample 201 are presented below.

C-2

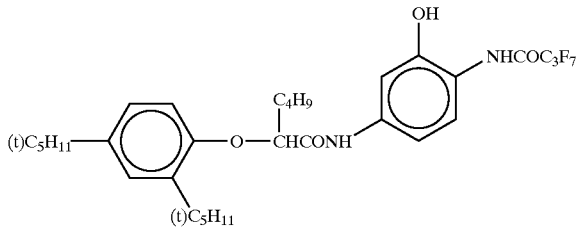

C-3

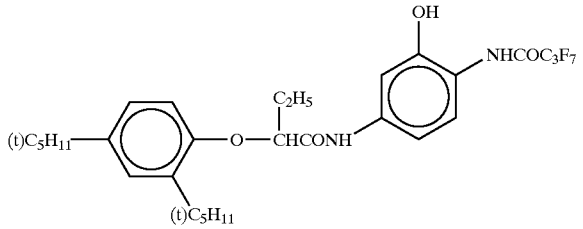

C-4

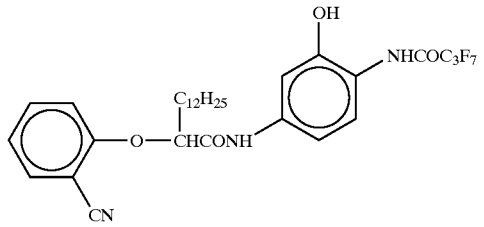

C-5

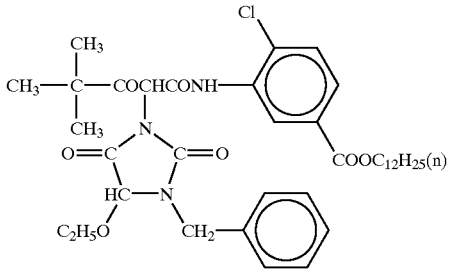

-continued
C-6
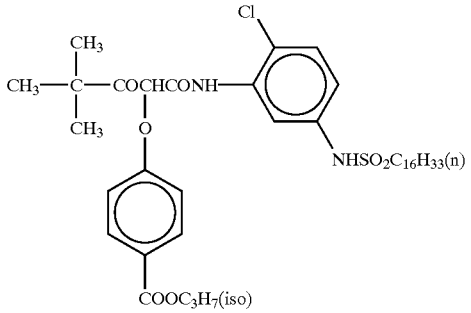
C-7
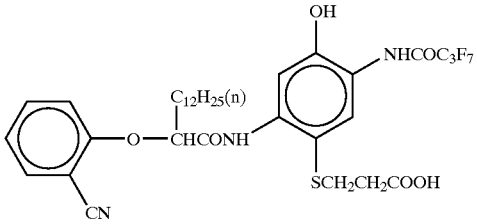
C-8
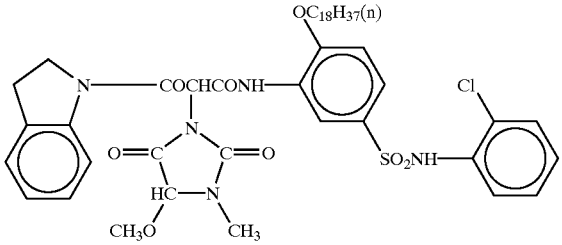
C-9
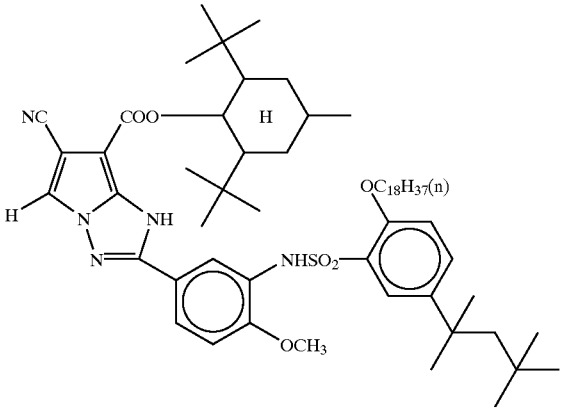
Oil-2
Dibutyl phthalate
Oil-3
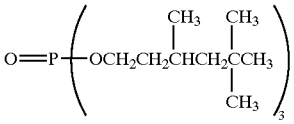
Oil-4
Tricyclohexyl phosphate
-continued
Oil-5
Dicyclohexyl phtalate
Oil-6
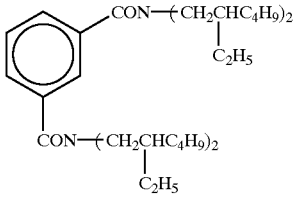
Oil-7
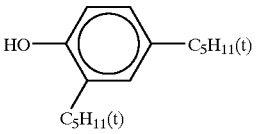
Oil-8
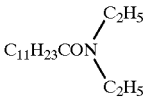
Oil-9
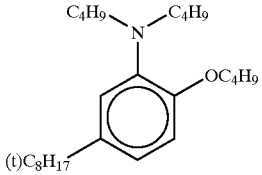
Cpd-A
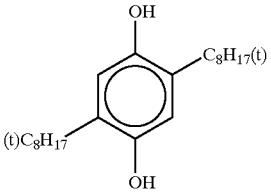
Cpd-B
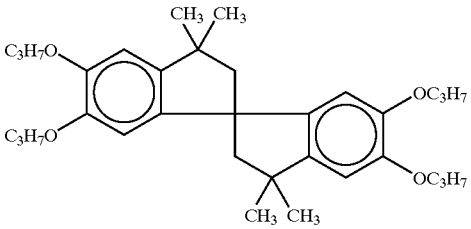
Cpd-C
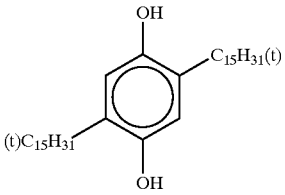
Cpd-D
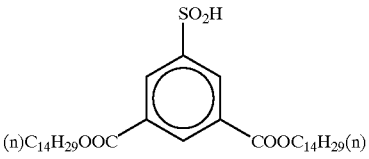

-continued
Cpd-E
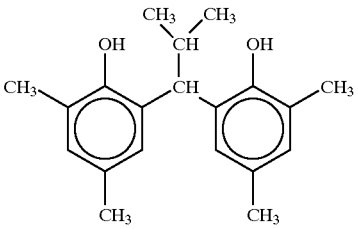
Cpd-F
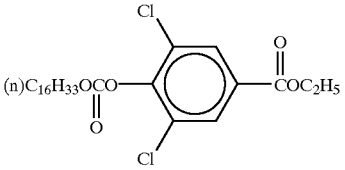
Cpd-G
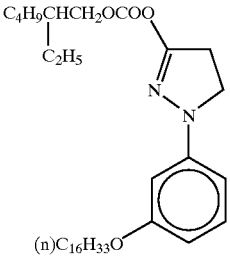
Cpd-H
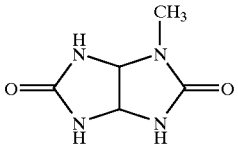
Cpd-I
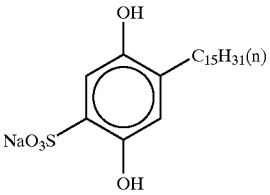
Cpd-J
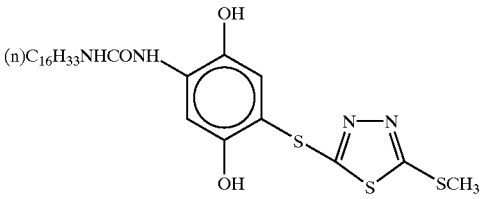
Cpd-K
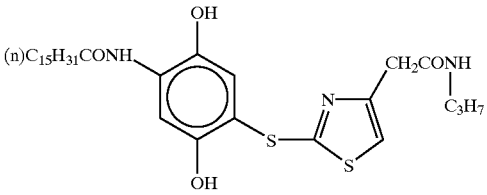
Cpd-L
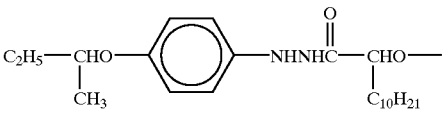
-continued
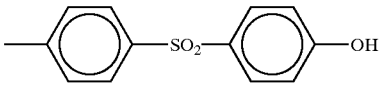
Cpd-M
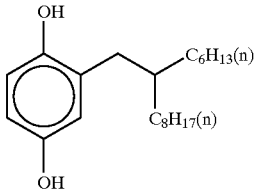
Cpd-N
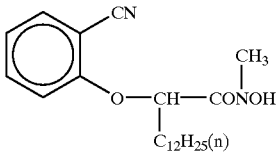
Cpd-O
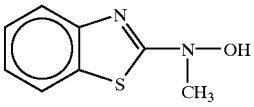
Cpd-P
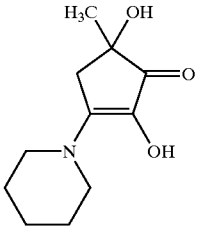
Cpd-Q
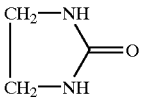
U-1
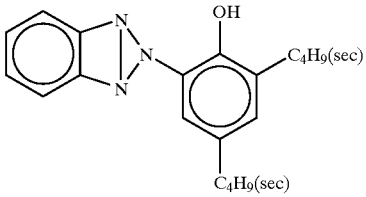
U-2
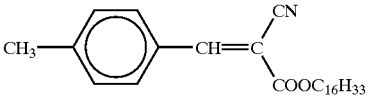
U-3
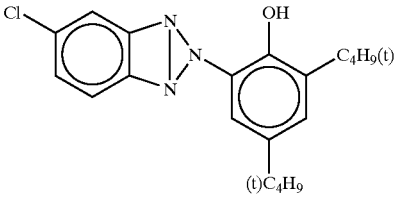

-continued
U-4
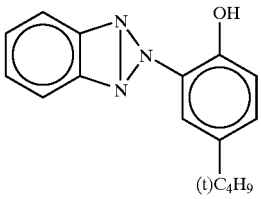
U-5
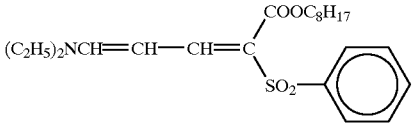
U-6
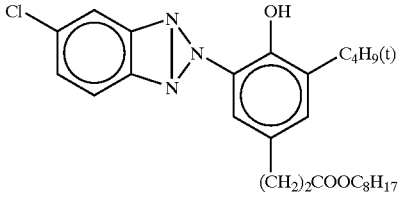
S-1
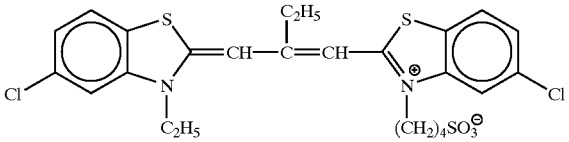
S-2
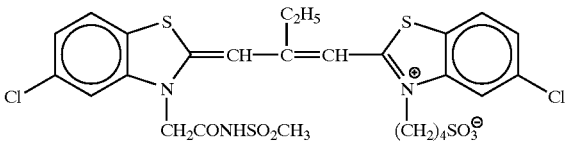
S-3
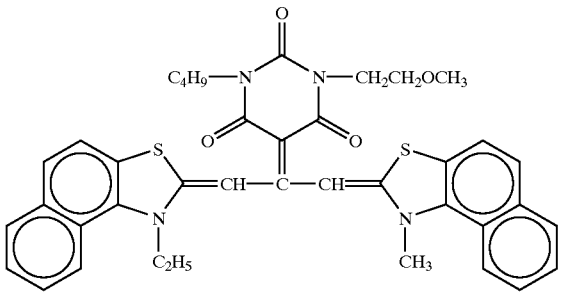
S-4
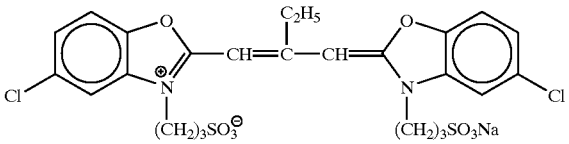
S-5
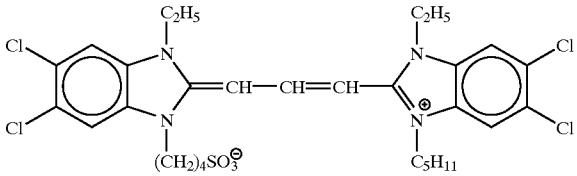
-continued
S-6
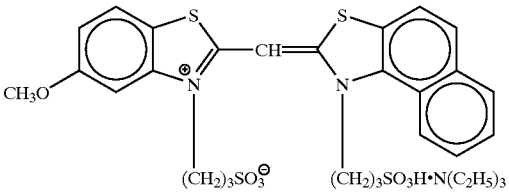
S-7
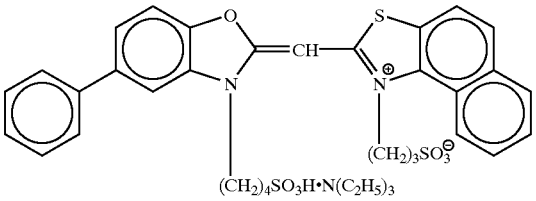
S-8
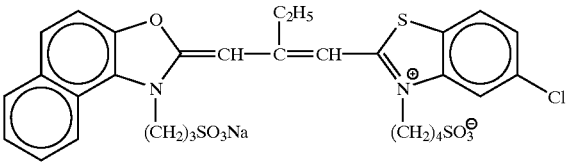
(Sensitizing dye S-8 has the same structure as that of sensitizing dye I-7 of this invention.)
S-9
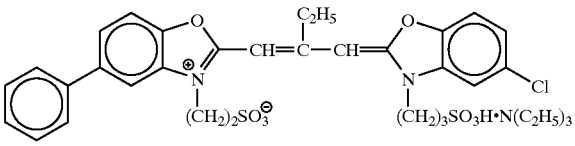
S-10
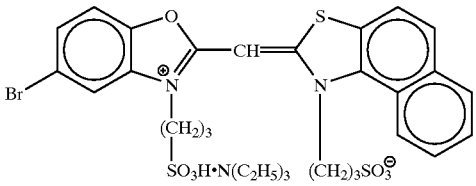
S-11
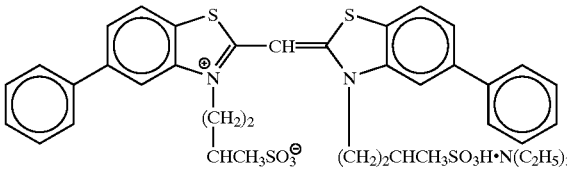
S-12
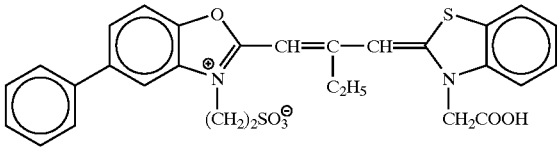

-continued
S-13
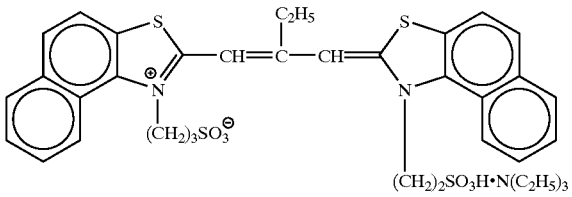
D-1
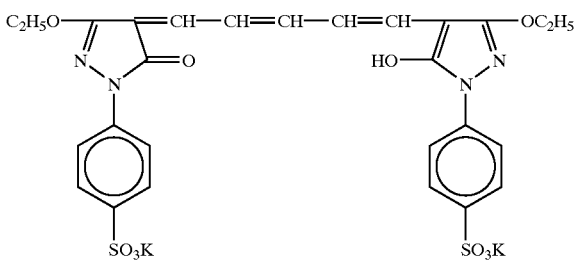
D-2
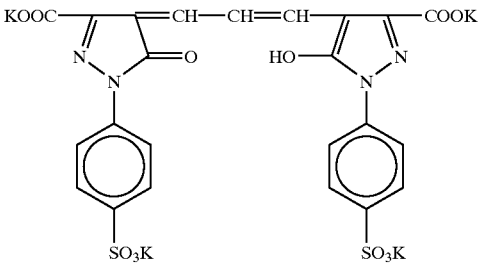
D-3
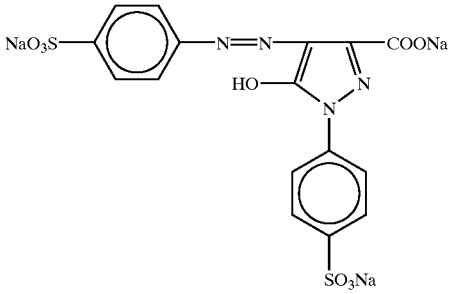
D-4
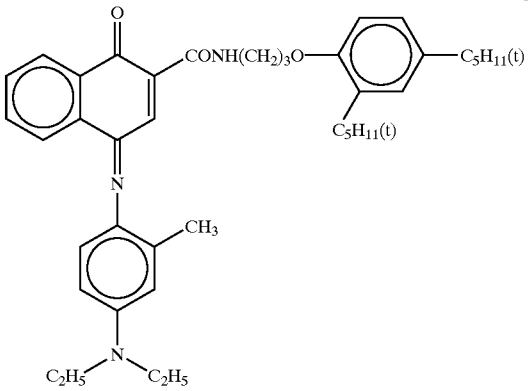
-continued
D-5
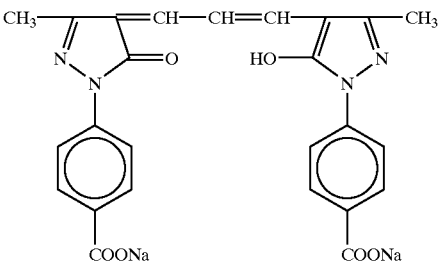
D-6
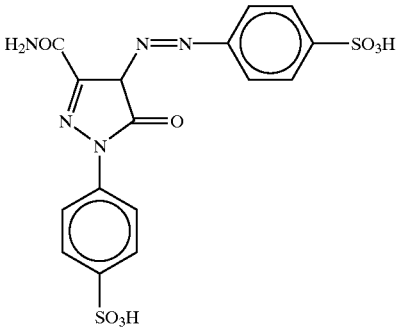
D-7
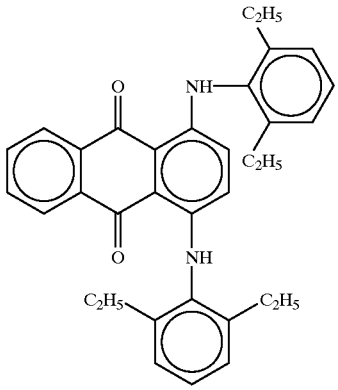
D-8
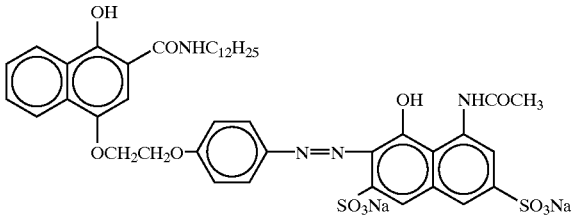
E-1
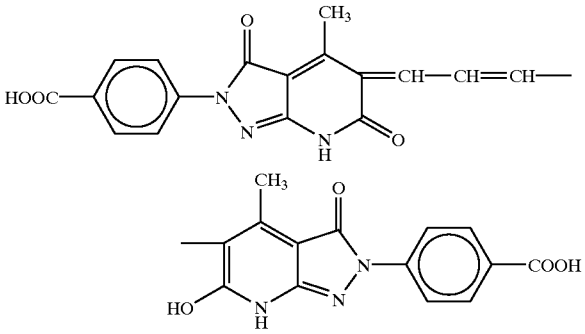

-continued
E-2
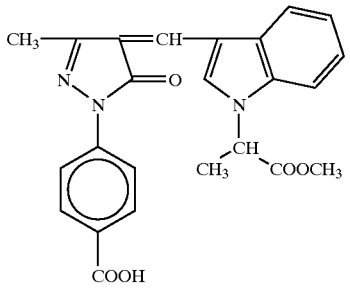
E-3
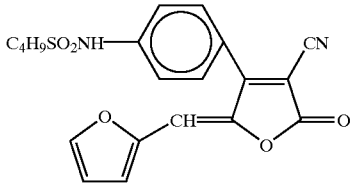
W-2
$C_8F_{17}SO_2NHCH_2CH_2CH_2OCH_2CH_2\overset{\oplus}{N}(CH_3)_3$
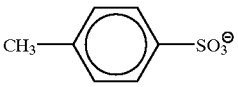
W-3
$C_8F_{17}SO_2N(C_3H_7)CH_2COOK$
W-4
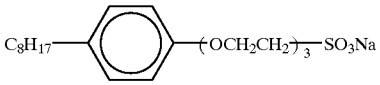
W-5
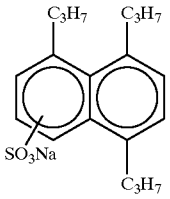
W-6
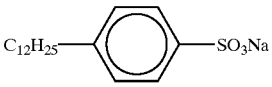
W-7
$C_8F_{17}SO_3Li$
P-1
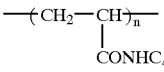
(n = 100 - 1000)
P-2
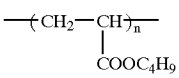
(n = 100 - 1000)
SO-1
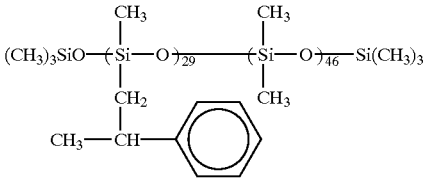
-continued
F-1
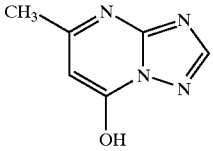
F-2
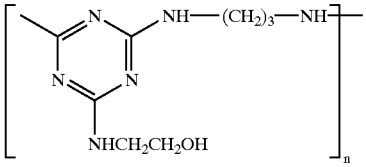
(n = 3 - 4)
F-3
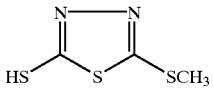
F-4
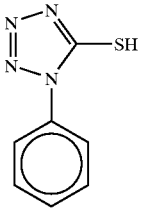
F-5
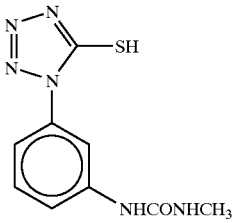
F-6
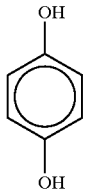
F-7
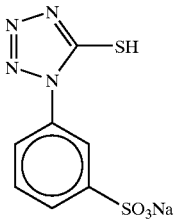
F-8
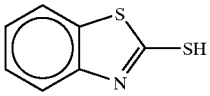

-continued

F-9

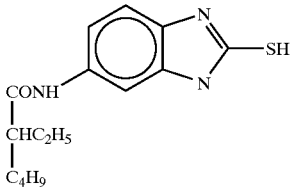

F-10

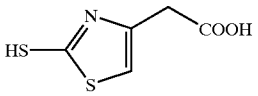

(Preparation of Dispersion of Organic Solid Disperse Dye)

The dye E-1 was dispersed by the following method. That is, water and 200 g of Pluronic F88 (ethylene oxide-propylene oxide block copolymer) manufactured by BASF CORP. were added to 1,430 g of a dye wet cake containing 30% of methanol, and the resultant material was stirred to form a slurry having a dye concentration of 6%. Next, Ultra Visco Mill (UVM-2) manufactured by Imex K.K. was filled with 1,700 mL of zirconia beads with an average grain size of 0.5 mm, and the slurry was milled through UVM-2 at a peripheral speed of approximately 10 m/sec and a discharge rate of 0.5 L/min for 8 hr. The beads were filtered away, and water was added to dilute the material to a dye concentration of 3%. After that, the material was heated at 90° C. for 10 hr for a stabilization purpose. The average grain size of the obtained fine dye grains was 0.60 μm. The grain size distribution (grain size standard deviation×100/average grain size) was 18%.

Following the same procedure as above, solid dispersions of the dyes E-2 and E-3 were obtained. The average grain sizes of the solid dispersions of the dyes E-2 and E-3 were found to be 0.54 and 0.56 μm, respectively.

Making of Samples 202–210

Samples 202 to 210 were made by changing the couplers in the 9th to 11th green-sensitive emulsion layers of sample 201 obtained as above to equal molar quantities of couplers shown in Table 5.

TABLE 5

| | Magenta couplers in 9th layer | | Magenta couplers in 10th layer | | Magenta couplers in 11th layer | |
|---|---|---|---|---|---|---|
| Sample No. | Types | Ratio | Types | Ratio | Types | Ratio |
| 201 (Comparative example) | I-5 | — | I-5 | — | I-5 | — |
| 202 (Comparative example) | I-18 | — | I-18 | — | I-18 | — |
| 203 (Comparative example) | II-13 | — | I-13 | — | I-13 | — |
| 204 (Comparative example) | II-4 | — | I-4 | — | I-4 | — |
| 205 (Present invention) | I-18/II-13 | 5/5 | I-18/II-13 | 5/5 | I-18/II-13 | 5/5 |
| 206 (Present invention) | I-5/II-4 | 3/7 | I-5/II-4 | 3/7 | I-5/II-4 | 3/7 |
| 207 (Present invention) | I-5/II-8 | 3/7 | I-5/II-8 | 3/7 | I-5/II-8 | 3/7 |
| 208 (Present invention) | I-17/II-11 | 3/7 | I-17/II-11 | 3/7 | I-17/II-11 | 3/7 |
| 209 (Present invention) | I-17/II-19 | 3/7 | I-17/II-19 | 3/7 | I-17/II-19 | 3/7 |
| 210 (Present invention) | I-18/II-23 | 3/7 | I-18/II-23 | 3/7 | I-18/II-23 | 3/7 |

Samples 201 to 210 obtained as above were evaluated following the same procedures as for the evaluation of the dependence on the pH of the color developer in Example 1. In Example 2, change rates at cyan, magenta, and yellow densities of 1.0 and 2.0 were obtained. The results are shown in Table 6.

TABLE 6

| | Dependence on pH of color developer | | | | | |
|---|---|---|---|---|---|---|
| | Density 1.0 | | | Density 2.0 | | |
| Sample No. | Cyan image | Magenta image | Yellow image | Cyan image | Magenta image | Yellow image |
| 201 (Comparative example) | −2 | −25 | −5 | −2 | −22 | −3 |
| 202 (Comparative example) | −2 | −21 | −5 | −1 | −19 | −2 |
| 203 (Comparative example) | −1 | +11 | −3 | 0 | +15 | −1 |
| 204 (Comparative example) | −2 | +18 | −2 | 0 | +20 | 0 |
| 205 (Present invention) | −1 | −3 | −1 | −1 | −5 | 0 |
| 206 (Present invention) | −1 | +1 | 0 | 0 | 0 | 0 |
| 207 (Present invention) | 0 | 0 | 0 | 0 | 0 | −1 |
| 208 (Present invention) | −2 | −1 | −1 | 0 | 0 | 0 |
| 209 (Present invention) | −1 | 0 | 0 | −1 | −1 | −1 |
| 210 (Present invention) | 0 | −1 | +1 | 0 | −4 | 0 |

From the results shown in Table 6, in each of samples 201 to 204 the rate of change in the magenta image density with pH variations in the color developer was extremely larger than the change rates of the cyan and yellow image densities, indicating a bad color density balance. In contrast, in samples 205 to 210 of the present invention, the change rates of the magenta image densities were small regardless of the combination of couplers of the present invention, and showed substantially the same changes as the change rates of the cyan and yellow image densities. Therefore, these samples 205 to 210 were superior in color density balance.

In addition, the dependence on the addition amount of the color developing agent, the granularity, and yellow stains caused by light, humidity, and heat were evaluated following the same procedures as in Example 1. Consequently, superior effects were obtained by samples 205 to 210 of the present invention as samples of the present invention in Example 1.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic lightsensitive material comprising at least one emulsion layer on a support, wherein at least one of the emulsion layers contains a coupler represented by formula (1) below and a coupler represented by formula (2) below at a molar ratio of 1:9 to 9:1:

(1)

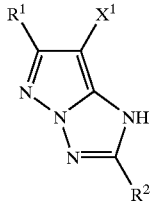

(2)

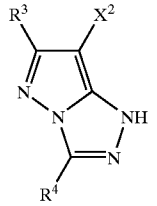

wherein each of $R^1$, $R^2$, $R^3$, and $R^4$ independently represents a hydrogen atom or a substituent; and each of $X^1$ and $X^2$ represents a hydrogen atom or a group capable of splitting off by coupling with the oxidized form of a developing agent, provided that at least one of $X^1$ and $X^2$ is a hydrogen atom.

2. A silver halide color photographic lightsensitive material comprising at least one emulsion layer on a support, wherein at least one of the emulsion layers contains a coupler represented by formula (1) below and a coupler represented by formula (3) below at a molar ratio of 1 9 to 9:1:

(1)

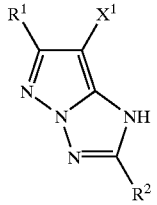

(3)

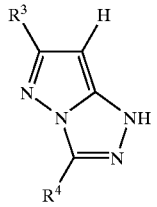

wherein each of $R^1$ and $R^2$ independently represents a hydrogen atom or a substituent; $X^1$ represents a hydrogen atom or a group capable of splitting off by coupling with the oxidized form of a developing agent; $R^3$ represents a substituted or nonsubstituted, 5- to 20-carbon secondary alkyl group or substituted or nonsubstituted, 4- to 20-carbon tertiary alkyl group; and $R^4$ represents a hydrogen atom or a substituent.

3. The lightsensitive material according to claim 2, wherein $R^3$ or $R^4$ in formula (3) has a dissociative substituent having a pka of not more than 10, which is measured at 25° C. in tetrahydrofuran:water=6:4.

4. A method for forming color image, wherein the lightsensitive material according to claim 1 is subjected to imagewise exposure, negative black-and-white development, and color development in this order.

5. The lightsensitive material according to claim 1, wherein each substituent of the formula (1) is as follows:

$R^1$ represents a substituted or nonsubstituted alkyl group having 1 to 20 carbon atoms; $R^2$ represents a substituted or nonsubstituted aryl group having 6 to 20 carbon atoms; and $X^1$ represents a halogen atom, aryloxy group having 6 to 20 carbon atoms, or hydrogen atom.

6. The lightsensitive material according to claim 1, wherein each substituent of the formula (1) is as follows:

$R^1$ represents a substituted or nonsubstituted tertiary alkyl group having 4 to 20 carbon atoms; $R^2$ represents a substituted secondary alkyl group having 3 to 20 carbon atoms or substituted aryl group having 6 to 20 carbon atoms; and $X^1$ represents a hydrogen atom or chlorine atom.

7. The lightsensitive material according to claim 1, wherein that each substituent of the formula (1) is as follows:

$R^1$ represents a nonsubstituted tertiary alkyl group having 4 to 20 carbon atoms; $R^2$ represents a substituted aryl group having 6 to 20 carbon atoms; and $X^1$ represents a chlorine atom.

8. The lightsensitive material according to claim 2, wherein each substituent of the formula (3) is as follows:

$R^3$ represents a substituted or nonsubstituted alkyl group having 1 to 20 carbon atoms; and $R^4$ represents a substituted or nonsubstituted alkyl group having 2 to 20 carbon atoms or substituted or nonsubstituted aryl group having 6 to 20 carbon atoms.

9. The lightsensitive material according to claim 2, wherein each substituent of the formula (3) is as follows:

$R^3$ represents a nonsubstituted tertiary alkyl group having 4 to 20 carbon atoms; and $R^4$ represents a substituted secondary alkyl group having 3 to 20 carbon atoms.

10. A method for forming color image, wherein the lightsensitive material according to claim 2 is subjected to imagewise exposure, negative black-and-white development, and color development in this order.

11. A method for forming color image, wherein the lightsensitive material according to claim 3 is subjected to imagewise exposure, negative black-and-white development, and color development in this order.

* * * * *